US008150701B2

(12) United States Patent
Oh et al.

(10) Patent No.: US 8,150,701 B2
(45) Date of Patent: Apr. 3, 2012

(54) METHOD AND APPARATUS FOR EMBEDDING SPATIAL INFORMATION AND REPRODUCING EMBEDDED SIGNAL FOR AN AUDIO SIGNAL

(75) Inventors: Hyen-O Oh, Gyeonggi-do (KR); Hee Suk Pang, Seoul (KR); Dong Soo Kim, Seoul (KR); Jae Hyun Lim, Seoul (KR); Yang-Won Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 897 days.

(21) Appl. No.: 11/915,574

(22) PCT Filed: May 26, 2006

(86) PCT No.: PCT/KR2006/002021

§ 371 (c)(1),
(2), (4) Date: Jul. 2, 2008

(87) PCT Pub. No.: WO2006/126859

PCT Pub. Date: Nov. 30, 2006

(65) Prior Publication Data

US 2009/0234656 A1 Sep. 17, 2009

Related U.S. Application Data

(60) Provisional application No. 60/684,578, filed on May 26, 2005, provisional application No. 60/758,608, filed on Jan. 13, 2006, provisional application No. 60/787,172, filed on Mar. 30, 2006.

(30) Foreign Application Priority Data

Apr. 4, 2006 (KR) ..... 10-2006-0030658
Apr. 4, 2006 (KR) ..... 10-2006-0030660
Apr. 4, 2006 (KR) ..... 10-2006-0030661
May 25, 2006 (KR) ..... 10-2006-0046972

(51) Int. Cl.
*G10L 19/00* (2006.01)

(52) U.S. Cl. ..... 704/500

(58) Field of Classification Search ..... 704/500–504
See application file for complete search history.

(56) References Cited

U.S. PATENT DOCUMENTS 4,621,862 A 11/1986 Kramer
(Continued)

FOREIGN PATENT DOCUMENTS

CN 1655651 8/2005
(Continued)

OTHER PUBLICATIONS

Stoll G: MPEG audio layer II. "A generic coding standard for two and multichannel sound for DVB, DAB and computer multimedia." International Broadcasting Convention, Sep. 14, 1995, 9 pages.

(Continued)

*Primary Examiner* — Michael N Opsasnick
(74) *Attorney, Agent, or Firm* — Fish & Richardson P.C.

(57) ABSTRACT

An apparatus for encoding and decoding an audio signal and method thereof are disclosed, by which compatibility with a player of a general mono or stereo audio signal can be provided in coding an audio signal and by which spatial information for a multi-channel audio signal can be stored or transmitted without a presence of an auxiliary data area. The present invention includes extracting side information embedded in non-recognizable component of audio signal components and decoding the audio signal using the extracted side information.

4 Claims, 26 Drawing Sheets

U.S. PATENT DOCUMENTS

| | | | | |
|---|---|---|---|---|
| 4,661,862 | A | 4/1987 | Thompson | |
| 4,725,885 | A | 2/1988 | Gonzales et al. | |
| 4,907,081 | A | 3/1990 | Okumura et al. | |
| 5,243,686 | A | 9/1993 | Tokuda et al. | |
| 5,481,643 | A | 1/1996 | Ten Kate et al. | |
| 5,515,296 | A | 5/1996 | Agarwal | |
| 5,528,628 | A | 6/1996 | Park et al. | |
| 5,530,750 | A | 6/1996 | Akagiri | |
| 5,563,661 | A | 10/1996 | Takahashi et al. | |
| 5,579,430 | A | 11/1996 | Grill et al. | |
| 5,606,618 | A | 2/1997 | Lokhoff et al. | |
| 5,621,856 | A | 4/1997 | Akagiri | |
| 5,640,159 | A | 6/1997 | Furlan et al. | |
| 5,682,461 | A | 10/1997 | Silzle et al. | |
| 5,687,157 | A | 11/1997 | Imai et al. | |
| 5,890,125 | A | 3/1999 | Davis et al. | |
| 5,912,636 | A | 6/1999 | Gormish et al. | |
| 5,945,930 | A | 8/1999 | Kajiwara | |
| 5,966,688 | A | 10/1999 | Nandkumar et al. | |
| 5,974,380 | A | 10/1999 | Smyth et al. | |
| 6,021,386 | A | 2/2000 | Davis et al. | |
| 6,125,398 | A | 9/2000 | Mirashrafi et al. | |
| 6,134,518 | A | 10/2000 | Cohen et al. | |
| 6,148,283 | A | 11/2000 | Das | |
| 6,208,276 | B1 | 3/2001 | Snyder | |
| 6,295,319 | B1 | 9/2001 | Sueyoshi et al. | |
| 6,309,424 | B1 | 10/2001 | Fallon | |
| 6,339,760 | B1 | 1/2002 | Koda et al. | |
| 6,384,759 | B2 | 5/2002 | Snyder | |
| 6,399,760 | B1 | 6/2002 | Gimeno et al. | |
| 6,421,467 | B1 | 7/2002 | Mitra | |
| 6,442,110 | B1 | 8/2002 | Yamamoto et al. | |
| 6,453,120 | B1 | 9/2002 | Takahashi et al. | |
| 6,456,966 | B1 | 9/2002 | Iwabuchi | |
| 6,556,685 | B1 | 4/2003 | Urry et al. | |
| 6,560,404 | B1 | 5/2003 | Okada et al. | |
| 6,611,212 | B1 | 8/2003 | Craven et al. | |
| 6,631,352 | B1 | 10/2003 | Fujita et al. | |
| 6,636,830 | B1 | 10/2003 | Princen et al. | |
| 7,334,176 | B2 | 2/2008 | Schröder | |
| 7,376,555 | B2 | 5/2008 | Schuijers et al. | |
| 7,391,870 | B2 * | 6/2008 | Herre et al. | 381/23 |
| 7,394,903 | B2 * | 7/2008 | Herre et al. | 381/23 |
| 7,447,317 | B2 * | 11/2008 | Herre et al. | 381/23 |
| 7,519,538 | B2 | 4/2009 | Villemoes et al. | |
| 2001/0055302 | A1 | 12/2001 | Taylor et al. | |
| 2002/0049586 | A1 | 4/2002 | Nishio et al. | |
| 2002/0106019 | A1 | 8/2002 | Chaddha et al. | |
| 2003/0009325 | A1 | 1/2003 | Kirchherr et al. | |
| 2003/0016876 | A1 | 1/2003 | Chai et al. | |
| 2003/0138157 | A1 | 7/2003 | Schwartz | |
| 2003/0195742 | A1 | 10/2003 | Tsushima | |
| 2003/0236583 | A1 | 12/2003 | Baumgarte et al. | |
| 2004/0049379 | A1 | 3/2004 | Thumpudi et al. | |
| 2004/0057523 | A1 | 3/2004 | Koto et al. | |
| 2004/0138895 | A1 | 7/2004 | Lokhoff et al. | |
| 2004/0186735 | A1 | 9/2004 | Ferris et al. | |
| 2004/0199276 | A1 | 10/2004 | Poon | |
| 2004/0247035 | A1 | 12/2004 | Schroder et al. | |
| 2005/0058304 | A1 | 3/2005 | Baumgarte et al. | |
| 2005/0074127 | A1 | 4/2005 | Herre et al. | |
| 2005/0074135 | A1 | 4/2005 | Kushibe | |
| 2005/0091051 | A1 | 4/2005 | Moriya et al. | |
| 2005/0114126 | A1 | 5/2005 | Geiger et al. | |
| 2005/0137729 | A1 | 6/2005 | Sakurai et al. | |
| 2005/0157883 | A1 | 7/2005 | Herre et al. | |
| 2005/0174269 | A1 | 8/2005 | Sherigar et al. | |
| 2005/0216262 | A1 | 9/2005 | Fejzo | |
| 2006/0023577 | A1 | 2/2006 | Shinoda et al. | |
| 2006/0085200 | A1 | 4/2006 | Allamanche et al. | |
| 2006/0190247 | A1 | 8/2006 | Lindblom | |
| 2007/0038439 | A1 | 2/2007 | Schiujers et al. | |
| 2007/0150267 | A1 | 6/2007 | Honma et al. | |
| 2009/0129601 | A1 * | 5/2009 | Ojala et al. | 381/1 |
| 2009/0185751 | A1 | 7/2009 | Kudo et al. | |

FOREIGN PATENT DOCUMENTS

| | | |
|---|---|---|
| DE | 69712383 | 1/2003 |
| EP | 372601 | 6/1990 |
| EP | 599825 | 6/1994 |
| EP | 0610975 | 8/1994 |
| EP | 827312 | 3/1998 |
| EP | 0943143 | 4/1999 |
| EP | 948141 | 10/1999 |
| EP | 957639 | 11/1999 |
| EP | 1001549 | 5/2000 |
| EP | 1047198 | 10/2000 |
| EP | 1376538 | 1/2004 |
| EP | 1396843 | 3/2004 |
| EP | 1869774 | 10/2006 |
| EP | 1905005 | 1/2007 |
| GB | 2238445 | 5/1991 |
| GB | 2340351 | 2/2002 |
| JP | 60-096079 | 5/1985 |
| JP | 62-094090 | 4/1987 |
| JP | 09-275544 | 10/1997 |
| JP | 11-205153 | 7/1999 |
| JP | 2001-188578 | 7/2001 |
| JP | 2002-521739 | 7/2002 |
| JP | 2001-53617 | 9/2002 |
| JP | 2002-328699 | 11/2002 |
| JP | 2002-335230 | 11/2002 |
| JP | 2003-005797 | 1/2003 |
| JP | 2003-233395 | 8/2003 |
| JP | 2004-110770 | 4/2004 |
| JP | 2004-170610 | 6/2004 |
| JP | 2004-220743 | 8/2004 |
| JP | 2005-063655 | 3/2005 |
| JP | 2005-332449 | 12/2005 |
| JP | 2006-120247 | 5/2006 |
| KR | 1997-0014387 | 3/1997 |
| KR | 2001-0001991 | 5/2001 |
| KR | 2003-0043620 | 6/2003 |
| KR | 2003-0043622 | 6/2003 |
| RU | 2158970 | 11/2000 |
| RU | 2214048 | 10/2003 |
| RU | 2221329 | 1/2004 |
| RU | 2005103637 | 7/2005 |
| TW | 204406 | 4/1993 |
| TW | 289885 | 11/1996 |
| TW | 317064 | 10/1997 |
| TW | 360860 | 6/1999 |
| TW | 378478 | 1/2000 |
| TW | 384618 | 3/2000 |
| TW | 405328 | 9/2000 |
| TW | 550541 | 9/2003 |
| TW | 567466 | 12/2003 |
| TW | 569550 | 1/2004 |
| TW | 200404222 | 3/2004 |
| TW | 1230530 | 4/2004 |
| TW | 200405673 | 4/2004 |
| TW | M257575 | 2/2005 |
| WO | WO 95/27337 | 10/1995 |
| WO | 97/40630 | 10/1997 |
| WO | 99/52326 | 10/1999 |
| WO | WO 99/56470 | 11/1999 |
| WO | 00/02357 | 1/2000 |
| WO | 00/60746 | 10/2000 |
| WO | WO 00/79520 | 12/2000 |
| WO | WO 03/046889 | 6/2003 |
| WO | 03/090028 | 10/2003 |
| WO | 03/090206 | 10/2003 |
| WO | 03/090207 | 10/2003 |
| WO | 03/090208 | 10/2003 |
| WO | WO 03/088212 | 10/2003 |
| WO | 2004/008806 | 1/2004 |
| WO | 2004/028142 | 4/2004 |
| WO | WO2004072956 | 8/2004 |
| WO | 2004/080125 | 9/2004 |
| WO | 2004/090868 | 10/2004 |
| WO | WO 2004/093495 | 10/2004 |
| WO | 2005/013491 | 2/2005 |
| WO | WO 2005/043511 | 5/2005 |
| WO | 2005/059899 | 6/2005 |

| | | |
|---|---|---|
| WO | 2006/027138 | 3/2006 |
| WO | WO 2006/048226 | 5/2006 |
| WO | WO 2006/108464 | 10/2006 |

OTHER PUBLICATIONS

European Office Action for Appln. No. 06747468.4, dated Feb. 2, 2010, 4 pages.
Notice of Allowance dated Sep. 25, 2009 issued in U.S. Appl. No. 11/540,920.
Office Action dated Jul. 14, 2009 issued in Taiwan Application No. 095136561.
Notice of Allowance dated Apr. 13, 2009 issued in Taiwan Application No. 095136566.
Bosi, M., et al. "ISO/IEC MPEG-2 Advanced Audio Coding." *Journal of the Audio Engineering Society* 45.10 (Oct. 1, 1997): 789-812. XP000730161.
Ehrer, A., et al. "Audio Coding Technology of ExAC." *Proceedings Of 2004 International Symposium On Hong Kong, China* Oct. 20, 2004, Piscataway, New Jersey. IEEE, 290-293. XP010801441.
European Examiner Christian Geiβler, European Search Report & Written Opinion for Application No. EP 06799113.3, dated Jul. 20, 2009, 10 pages.
European Examiner Nicolas Chetry, European Search Report & Written Opinion for Application No. EP 06799111.7 dated Jul. 10, 2009, 12 pages.
European Examiner U. Ramos Sanchez, European Search Report & Written Opinion for Application No. EP 06799107.5, dated Aug. 24, 2009, 6 pages.
European Examiner U. Ramos Sanchez, European Search Report & Written Opinion for Application No. EP 06799108.3, dated Aug. 24, 2009, 7 pages.
Korean Examiner Beak Su Lee, International Preliminary Report on Patentability for Application No. PCT/KR2006/004332, dated Jan. 25, 2007, 3 pages.
Korean Examiner Ho Sun, Korean Intellectual Property Office Notice of Allowance for No. 10-2008-7005993, dated Jan. 13, 2009, 3 pages.
Russian Examiner B. P. Simonov, Russian Notice of Allowance for Application No. 2008112174, dated Sep. 11, 2009, 13 pages.
Schuller, Gerald D.T., et al. "Perceptual Audio Coding Using Adaptive Pre- and Post-Filters and Lossless Compression." *IEEE Transactions on Speech and Audio Processing* New York, 10.6 (Sep. 1, 2002): 379. XP011079662.
Taiwan Examiner, Taiwanese Office Action for Application No. 095124113, dated Jul. 21, 2008, 13 pages.
Taiwan Examiner Hung-Long Wu, Taiwanese Notice of Allowance for Application No. 95124070, dated Sep. 18, 2008, 7 pages.
Taiwan Examiner Hung-Long Wu, Taiwanese Notice of Allowance for Application No. 95124112, dated Jul. 20, 2009, 5 pages.
Tewfik, A.H., et al. "Enhance wavelet based audio coder." *IEEE*. (1993): 896-900. XP010096271.
U.S. Examiner Douglas C. Godbold, USPTO Non-Final Office Action in U.S. Appl. No. 11/514,302, mailed Sep. 9, 2009, 24 pages.
USPTO Notice of Allowance in U.S. Appl. No. 12/089,098, mailed Sep. 8, 2009, 19 pages.
Chou et. al., "Audio Data Hiding with Application to Surround Sound," IEEE International Conference on Acoustics, Speech, and Signal Processing, 2003, vol. 2, pp. 337-340.
Office Action, Chinese Appln. No. 200680026311.9, dated Oct. 27, 2010, 17 pages with English translation.
Office Action, Japanese Appln. No. 2008-513379, dated Dec. 24, 2010, 8 pages with English translation.
Examiner Susan Iris McFadden, Office Action, U.S. Appl. No. 11/915,325, dated Jun. 22, 2011, 7 pages.
"Text of second working draft for MPEG Surround", ISO/IEC JTC 1/SC 29/WG 11, No. N7387, No. N7387, Jul. 29, 2005, 140 pages.
Deputy Chief of the Electrical and Radio Engineering Department Makhotna, S.V., Russian Decision on Grant Patent for Russian Patent Application No. 2008112226 dated Jun. 5, 2009, and its translation, 15 pages.
Extended European search report for European Patent Application No. 06799105.9 dated Apr. 28, 2009, 11 pages.
Supplementary European Search Report for European Patent Application No. 06799058 dated Jun. 16, 2009, 6 pages.
Supplementary European Search Report for European Patent Application No. 06757751 dated Jun. 8, 2009, 5 pages.
Herre, J. et al., "Overview of MPEG-4 audio and its applications in mobile communication", Communication Technology Proceedings, 2000. WCC—ICCT 2000. International Confrence on Beijing, China held Aug. 21-25, 2000, Piscataway, NJ, USA, IEEE, US, vol. 1 (Aug. 21, 2008), pp. 604-613.
Oh, H-O et al., "Proposed core experiment on pilot-based coding of spatial parameters for MPEG surround", ISO/IEC JTC 1/SC 29/WG 11, No. M12549, Oct. 13, 2005, 18 pp. XP030041219.
Pang, H-S, "Clipping Prevention Scheme for MPEG Surround", ETRI Journal, vol. 30, No. 4 (Aug. 1, 2008), pp. 606-608.
Quackenbush, S. R. et al., "Noiseless coding of quantized spectral components in MPEG-2 Advanced Audio Coding", Application of Signal Processing to Audio and Acoustics, 1997. 1997 IEEE ASSP Workshop on New Paltz, NY, US held on Oct. 19-22, 1997, New York, NY, US, IEEE, US, (Oct. 19, 1997), 4 pages.
Russian Decision on Grant Patent for Russian Patent Application No. 2008103314 dated Apr. 27, 2009, and its translation, 11 pages.
USPTO Non-Final Office Action in U.S. Appl. No. 12/088,868, mailed Apr. 1, 2009, 11 pages.
USPTO Non-Final Office Action in U.S. Appl. No. 12/088,872, mailed Apr. 7, 2009, 9 pages.
USPTO Non-Final Office Action in U.S. Appl. No. 12/089,383, mailed Jun. 25, 2009, 5 pages.
USPTO Non-Final Office Action in U.S. Appl. No. 11/540,920, mailed Jun. 2, 2009, 8 pages.
USPTO Non-Final Office Action in U.S. Appl. No. 12/089,105, mailed Apr. 20, 2009, 5 pages.
USPTO Non-Final Office Action in U.S. Appl. No. 12/089,093, mailed Jun. 16, 2009, 10 pages.
Bessette B, et al.: Universal Speech/Audio Coding Using Hybrid ACELP/TCX Techniques, 2005, 4 pages.
Boltze Th. et al.; "Audio services and applications." In: Digital Audio Broadcasting. Edited by Hoeg, W. and Lauferback, Th. ISBN 0-470-85013-2. John Wiley & Sons Ltd., 2003. pp. 75-83.
Breebaart, J., AES Convention Paper 'MPEG Spatial audio coding/MPEG surround: Overview and Current Status', 119th Convention, Oct. 7-10, 2005, New York, New York, 17 pages.
Chou, J. et al.: Audio Data Hiding with Application to Surround Sound, 2003, 4 pages.
Faller C., et al.: Binaural Cue Coding- Part II: Schemes and Applications, 2003, 12 pages, IEEE Transactions on Speech and Audio Processing, vol. 11, No. 6.
Faller C.: Parametric Coding of Spatial Audio. Doctoral thesis No. 3062, 2004, 6 pages.
Faller, C: "Coding of Spatial Audio Compatible with Different Playback Formats", Audio Engineering Society Convention Paper, 2004, 12 pages, San Francisco, CA.
Hamdy K.N., et al.: Low Bit Rate High Quality Audio Coding with Combined Harmonic and Wavelet Representations, 1996, 4 pages.
Heping, D.,: Wideband Audio Over Narrowband Low-Resolution Media, 2004, 4 pages.
Herre, J. et al.: MP3 Surround: Efficient and Compatible Coding of Multi-channel Audio, 2004, 14 pages.
Herre, J. et al: The Reference Model Architecture for MPEG Spatial Audio Coding, 2005, 13 pages, Audio Engineering Society Convention Paper.
Hosoi S., et al.: Audio Coding Using the Best Level Wavelet Packet Transform and Auditory Masking, 1998, 4 pages.
International Search Report corresponding to International Application No. PCT/KR2006/002018 dated Oct. 16, 2006, 1 page.
International Search Report corresponding to International Application No. PCT/KR2006/002019 dated Oct. 16, 2006, 1 page.
International Search Report corresponding to International Application No. PCT/KR2006/002020 dated Oct. 16, 2006, 2 pages.
International Search Report corresponding to International Application No. PCT/KR2006/002021 dated Oct. 16, 2006, 1 page.
International Search Report corresponding to International Application No. PCT/KR2006/002575, dated Jan. 12, 2007, 2 pages.

International Search Report corresponding to International Application No. PCT/KR2006/002578, dated Jan. 12, 2007, 2 pages.
International Search Report corresponding to International Application No. PCT/KR2006/002579, dated Nov. 24, 2006, 1 page.
International Search Report corresponding to International Application No. PCT/KR2006/002581, dated Nov. 24, 2006, 2 pages.
International Search Report corresponding to International Application No. PCT/KR2006/002583, dated Nov. 24, 2006, 2 pages.
International Search Report corresponding to International Application No. PCT/KR2006/003420, dated Jan. 18, 2007, 2 pages.
International Search Report corresponding to International Application No. PCT/KR2006/003424, dated Jan. 31, 2007, 2 pages.
International Search Report corresponding to International Application No. PCT/KR2006/003426, dated Jan. 18, 2007, 2 pages.
International Search Report corresponding to International Application No. PCT/KR2006/003435, dated Dec. 13, 2006, 1 page.
International Search Report corresponding to International Application No. PCT/KR2006/003975, dated Mar. 13, 2007, 2 pages.
International Search Report corresponding to International Application No. PCT/KR2006/004014, dated Jan. 24, 2007, 1 page.
International Search Report corresponding to International Application No. PCT/KR2006/004017, dated Jan. 24, 2007, 1 page.
International Search Report corresponding to International Application No. PCT/KR2006/004020, dated Jan. 24, 2007, 1 page.
International Search Report corresponding to International Application No. PCT/KR2006/004024, dated Jan. 29, 2007, 1 page.
International Search Report corresponding to International Application No. PCT/KR2006/004025, dated Jan. 29, 2007, 1 page.
International Search Report corresponding to International Application No. PCT/KR2006/004027, dated Jan. 29, 2007, 1 page.
International Search Report corresponding to International Application No. PCT/KR2006/004032, dated Jan. 24, 2007, 1 page.
International Search Report in corresponding International Application No. PCT/KR2006/004023, dated Jan. 23, 2007, 1 page.
ISO/IEC 13818-2, Generic Coding of Moving Pictures and Associated Audio, Nov. 1993, Seoul, Korea.
ISO/IEC 14496-3 Information Technology—Coding of Audio-Visual Objects—Part 3: Audio, Second Edition (ISO/IEC), 2001.
Jibra A., et al.: Multi-layer Scalable LPC Audio Format; ISACS 2000, 4 pages, IEEE International Symposium on Circuits and Systems.
Jin C, et al.: Individualization in Spatial-Audio Coding, 2003, 4 pages, IEEE Workshop on Applications of Signal Processing to Audio and Acoustics.
Kostantinides K: An introduction to Super Audio CD and DVD-Audio, 2003, 12 pages, IEEE Signal Processing Magazine.
Liebchem, T.; Reznik, Y.A.: MPEG-4: an Emerging Standard for Lossless Audio Coding, 2004, 10 pages, Proceedings of the Data Compression Conference.
Ming, L.: A novel random access approach for MPEG-1 multicast applications, 2001, 5 pages.
Moon, Han-gil, et al.: A Multi-Channel Audio Compression Method with Virtual Source Location Information for MPEG-4 SAC, IEEE 2005, 7 pages.
Moriya T., et al.,: A Design of Lossless Compression for High-Quality Audio Signals, 2004, 4 pages.
Notice of Allowance dated Aug. 25, 2008 by the Korean Patent Office for counterpart Korean Appln. Nos. 2008-7005851, 7005852; and 7005858.
Notice of Allowance dated Dec. 26, 2008 by the Korean Patent Office for counterpart Korean Appln. Nos. 2008-7005836, 7005838, 7005839, and 7005840.
Notice of Allowance dated Jan. 13, 2009 by the Korean Patent Office for a counterpart Korean Appln. No. 2008-7005992.
Office Action dated Jul. 21, 2008 issued by the Taiwan Patent Office, 16 pages.
Oh, E., et al.: Proposed changes in MPEG-4 BSAC multi channel audio coding, 2004, 7 pages, International Organisation for Standardisation.
Pang, H., et al., "Extended Pilot-Based Codling for Lossless Bit Rate Reduction of MPEG Surround", ETRI Journal, vol. 29, No. 1, Feb. 2007.
Pun, A., et al.: MPEG-4: An object-based multimedia coding standard supporting mobile applications, 1998, 28 pages, Baltzer Science Publishers BV.
Said, A.: On the Reduction of Entropy Coding Complexity via Symbol Grouping: I—Redundancy Analysis and Optimal Alphabet Partition, 2004, 42 pages, Hewlett-Packard Company.
Schroeder E F et al: DER MPEG-2STANDARD: Generische Codierung fur Bewegtbilder und zugehorige Audio-Information, 1994, 5 pages.
Schuijers, E. et al: Low Complexity Parametric Stereo Coding, 2004, 6 pages, Audio Engineering Society Convention Paper 6073.
Stoll, G.: MPEG Audio Layer II: A Generic Coding Standard for Two and Multichannel Sound for DVB, DAB and Computer Multimedia, 1995, 9 pages, International Broadcasting Convention, XP006528918.
Supplementary European Search Report corresponding to Application No. EP06747465, dated Oct. 10, 2008, 8 pages.
Supplementary European Search Report corresponding to Application No. EP06747467, dated Oct. 10, 2008, 8 pages.
Supplementary European Search Report corresponding to Application No. EP06757755, dated Aug. 1, 2008, 1 page.
Supplementary European Search Report corresponding to Application No. EP06843795, dated Aug. 7, 2008, 1 page.
Ten Kate W. R. Th., et al.: A New Surround-Stereo-Surround Coding Technique, 1992, 8 pages, J. Audio Engineering Society, XP002498277.
Voros P.: High-quality Sound Coding within 2x64 kbit/s Using Instantaneous Dynamic Bit-Allocation, 1988, 4 pages.
Webb J., et al.: Video and Audio Coding for Mobile Applications, 2002, 8 pages, The Application of Programmable DSPs in Mobile Communications.
Notice of Allowance, dated Feb. 27, 2009, issued in counterpart Korean Application Serial No. 08-7007453 (no English translation available).

* cited by examiner

METHOD AND APPARATUS FOR EMBEDDING SPATIAL INFORMATION AND REPRODUCING EMBEDDED SIGNAL FOR AN AUDIO SIGNAL

TECHNICAL FIELD

The present invention relates to a method of encoding and decoding an audio signal.

BACKGROUND ART

Recently, many efforts are made to research and develop various coding schemes and methods for digital audio signals and products associated with the various coding schemes and methods are manufactured.

And, coding schemes for changing a mono or stereo audio signal into multi-channel audio signal using spatial information of the multi-channel audio signal have been developed.

However, in case of storing an audio signal in some recording media, an auxiliary data area for storing spatial information does not exist. So, in this case, only a mono or stereo audio signal is reproduced because the mono or stereo audio signal is stored or transmitted. Hence, a sound quality is monotonous.

Moreover, in case of storing or transmitting spatial information separately, there exists a problem of compatibility with a player of a general mono or stereo audio signal.

DISCLOSURE OF THE INVENTION

Accordingly, the present invention is directed to an apparatus for encoding and decoding an audio signal and method thereof that substantially obviate one or more of the problems due to limitations and disadvantages of the related art.

An object of the present invention is to provide an apparatus for encoding and decoding an audio signal and method thereof, by which compatibility with a player of a general mono or stereo audio signal can be provided in coding an audio signal.

Another object of the present invention is to provide an apparatus for encoding and decoding an audio signal and method thereof, by which spatial information for a multi-channel audio signal can be stored or transmitted without a presence of an auxiliary data area.

Additional features and advantages of the present invention will be set forth in the description which follows, and in part will be apparent from the description, or may be learned by practice of the invention. The objectives and other advantages of the present invention will be realized and attained by the structure particularly pointed out in the written description and claims thereof as well as the appended drawings.

To achieve these and other advantages and in accordance with the purpose of the present invention, a method of decoding an audio signal according to the present invention includes the steps of extracting side information in either a case of embedding the side information in the audio signal by a frame unit with a frame length defined per a frame or a case of attaching the side information to the audio signal by a frame unit and decoding the audio signal using the extracted side information.

To further achieve these and other advantages and in accordance with the purpose of the present invention, a method of encoding an audio signal according to the present invention includes the steps of generating the audio signal and side information necessary for decoding the audio signal and executing either a step of embedding the side information in the audio signal by a frame unit with a frame length defined per a frame or a step of attaching the side information to the audio signal by a frame unit.

To further achieve these and other advantages and in accordance with the purpose of the present invention, a data structure according to the present invention includes an audio signal and side information embedded by a frame unit with a frame length defined per a frame in non-recognizable components of the audio signal or side information attached to an area which is not used for decoding of the audio signal by the frame unit.

To further achieve these and other advantages and in accordance with the purpose of the present invention, an apparatus for encoding an audio signal according to the present invention includes an audio signal generating unit for generating the audio signal, an side information generating unit for generating side information necessary for decoding the audio signal and an side information attaching unit for performing a process of embedding the side information in the audio signal by a frame unit with a frame length defined per a frame or a process of attaching the side information to the audio signal by a frame unit.

To further achieve these and other advantages and in accordance with the purpose of the present invention, an apparatus for decoding an audio signal according to the present invention includes an side information extracting unit for extracting side information in case that the side information is embedded in the audio signal by a frame unit with a frame length defined per a frame or in case that the side information is attached to the audio signal by the frame unit and a multi-channel generating unit for decoding the audio signal by using the side information.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings.

First of all, the present invention relates to an apparatus for embedding side information necessary for decoding an audio signal in the audio signal and method thereof. For the convenience of explanation, the audio signal and side information are represented as a downmix signal and spatial information in the following description, respectively, which does not put limitation on the present invention. In this case, the audio signal includes a PCM signal.

Figure 1:
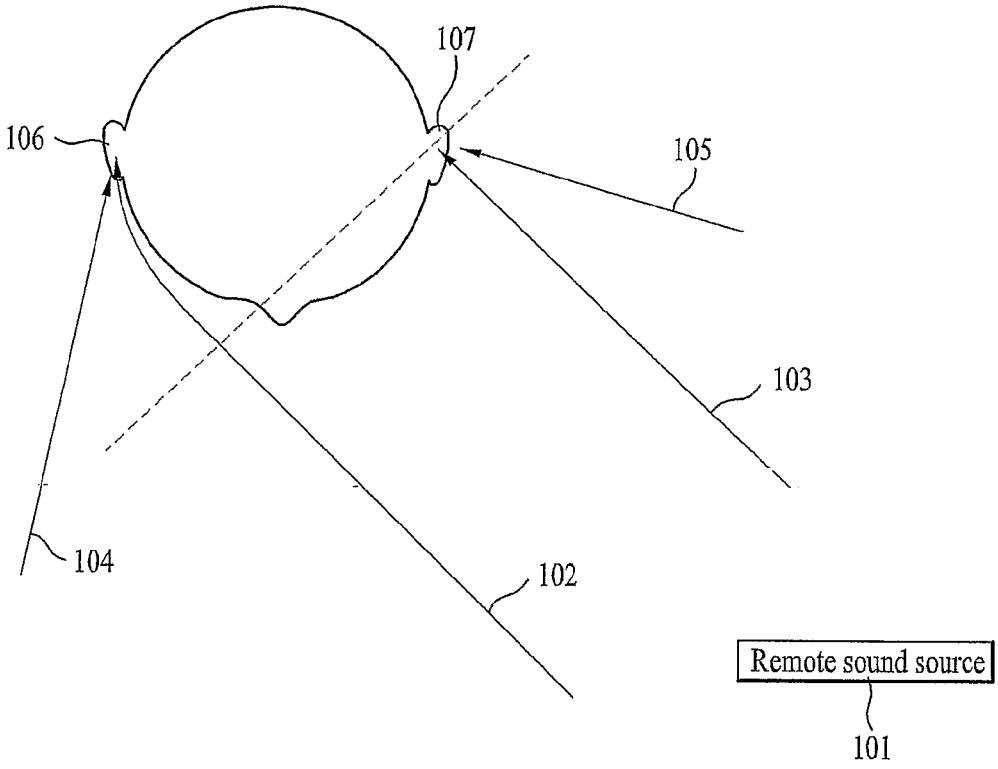
FIG. 1 is a diagram for explaining a method that a human recognizes spatial information for an audio signal according to the present invention.

FIG. 1 is a diagram for explaining a method that a human recognizes spatial information for an audio signal according to the present invention Referring to FIG. 1, based on a fact that a human is able to recognize an audio signal 3-dimensionally, a coding scheme for a multi-channel audio signal uses a fact that the audio signal can be represented as 3-dimensional spatial information via a plurality of parameter sets.

Spatial parameters for representing spatial information of a multi-channel audio signal include CLD (channel level differences), ICC (inter-channel coherences), CTD (channel time difference), etc. The CLD means an energy difference between two channels, the ICC means a correlation between two channels, and the CTD means a time difference between two channels.

How a human recognizes an audio signal spatially and how a concept of the spatial parameter is generated are explained with reference to FIG. 1.

A direct sound wave 103 arrives at a left ear of a human from a remote sound source 101, while another direct sound wave 102 is diffracted around a head to reach a right ear 106 of the human.

The two sound waves 102 and 103 differ from each other in arriving time and energy level. And, the CTD and CLD parameters are generated by using theses differences.

If reflected sound waves 104 and 105 arrive at both of the ears, respectively or if the sound source is dispersed, sound waves having no correlation in-between will arrive at both of the ears, respectively to generate the ICC parameter.

Using the generated spatial parameters according to the above-explained principle, it is able to transmit a multi-channel audio signal as a mono or stereo signal and to output the signal into a multi-channel signal.

The present invention provides a method of embedding the spatial information, i.e., the spatial parameters in the mono or stereo audio signal, transmitting the embedded signal, and reproducing the transmitted signal into a multi-channel audio signal. The present invention is not limited to the multi-channel audio signal. In the following description of the present invention, the multi-channel audio signal is explained for the convenience of explanation.

Figure 2:
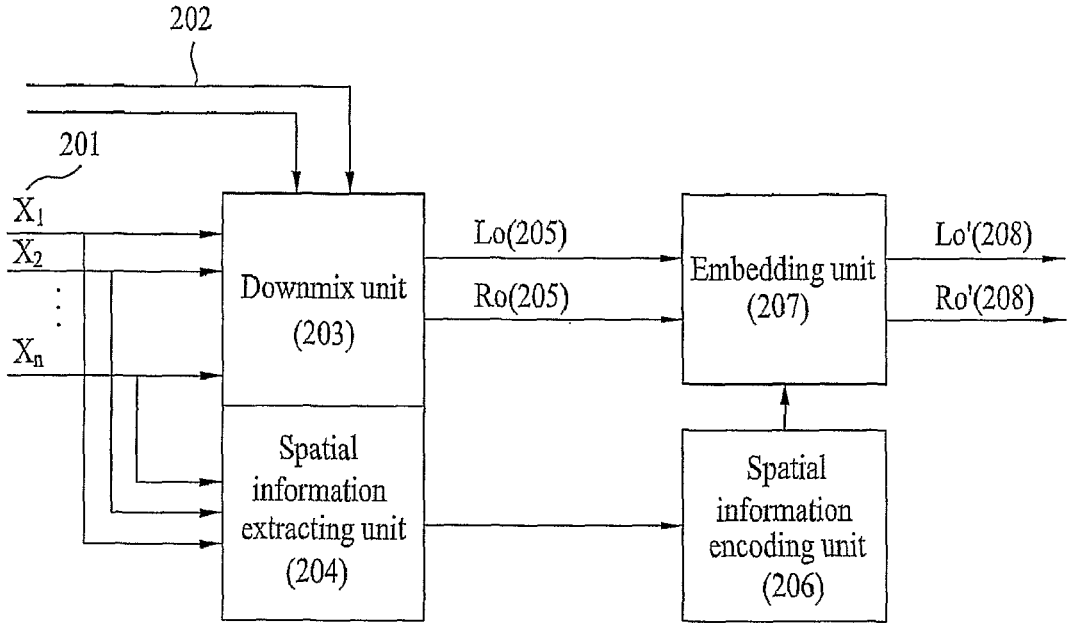
FIG. 2 is a block diagram of a spatial encoder according to the present invention.

FIG. 2 is a block diagram of an encoding apparatus according to the present invention.

Referring to FIG. 2, the encoding apparatus according to the present invention receives a multi-channel audio signal 201. In this case, 'n' indicates the number of input channels.

The multi-channel audio signal 201 is converted to a downmix signal (Lo and Ro) 205 by an audio signal generating unit 203. The downmix signal includes a mono or stereo audio signal and can be a multi-channel audio signal. In the present invention, the stereo audio signal will be taken as an example in the following description. Yet, the present invention is not limited to the stereo audio signal.

Spatial information of the multi-channel audio signal, i.e., a spatial parameter is generated from the multi-channel audio signal 201 by a side information generating unit 204. In the present invention, the spatial information indicates information for an audio signal channel used in transmitting the downmixed signal 205 generated by downmixing a multichannel (e.g., left, right, center, left surround, right surround, etc.) signal and upmixing the transmitted downmix signal into the multi-channel audio signal again. Optionally, the downmix signal 205 can be generated using a downmix signal directly provided from outside, e.g., an artistic downmix signal 202.

The spatial information generated in the side information generating unit 204 is encoded into a spatial information bitstream for transmission and storage by an side information encoding unit 206.

The spatial information bitstream is appropriately reshaped to be directly inserted in an audio signal, i.e., the downmix signal 205 to be transmitted by an embedding unit 207. In doing so, 'digital audio embedded method' is usable.

For instance, in case that the downmix signal 205 is a raw PCM audio signal to be stored in a storage medium (e.g., stereo compact disc) difficult to store the spatial information therein or to be transmitted by SPDIF (Sony/Philips Digital Interface), an auxiliary data field for storing the spatial information does not exist unlike the case of compression encoding by AAC or the like.

In this case, if the 'digital audio embedded method' is used, the spatial information can be embedded in the raw PCM audio signal without sound quality distortion. And, the audio signal having the spatial information embedded therein is not discriminated from the raw signal in aspect of a general decoder. Namely, an output signal Lo'/Ro' 208 having the spatial information embedded therein can be regarded as a same signal of the input signal Lo/Ro 205 in aspect of a general PCM decoder.

As the 'digital audio embedded method', there is a 'bit replacement coding method', an 'echo hiding method', a 'spread-spectrum based method' or the like.

The bit replacement coding method is a method of inserting specific information by modifying lower bits of a quantized audio sample. In an audio signal, modification of lower bits almost has no influence on a quality of the audio signal.

The echo hiding method is a method of inserting an echo small enough not to be heard by human ears in an audio signal.

And, the spread-spectrum based method is a method of transforming an audio signal into a frequency domain via discrete cosine transform, discrete Fourier transform or the like, performing spread spectrum on specific binary information into PN (pseudo noise) sequence, and adding it to the audio signal transformed into the frequency domain.

In the present invention, the bit replacement coding method will be mainly explained in the following description. Yet, the present invention is not limited to the bit replacement coding method.

Figure 3:
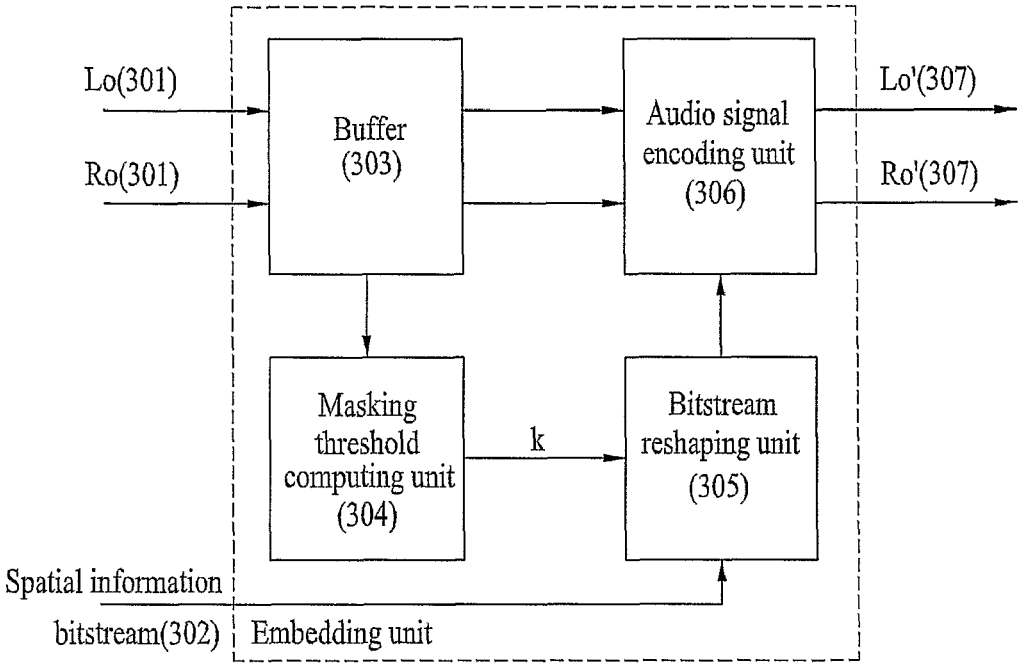
FIG. 3 is a detailed block diagram of an embedding unit configuring the spatial encoder shown in FIG. 2 according to the present invention.

FIG. 3 is a detailed block diagram of an embedding unit configuring the spatial encoder shown in FIG. 2 according to the present invention.

Referring to FIG. 3, in embedding spatial information in non-perceptive components of downmix signal components by the bit replacement coding method, an insertion bit length (hereinafter named 'K-value') for embedding the spatial information can use K-bit (K>0) according to a pre-decided method instead of using a lower 1-bit only. The K-bit can use lower bits of the downmix signal but is not limited to the lower bits only. In this case, the pre-decided method is a method of finding a masking threshold according to a psychoacoustic model and allocating a suitable bit according to the masking threshold for example.

A downmix signal Lo/Ro 301, as shown in the drawing, is transferred to an audio signal encoding unit 306 via a buffer 303 within the embedding unit.

A masking threshold computing unit 304 segments an inputted audio signal into predetermined sections (e.g., blocks) and then finds a masking threshold for the corresponding section.

The masking threshold computing unit 304 finds an insertion bit length (i.e., K value) of the downmix signal enabling a modification without occurrence of aural distortion according to the masking threshold. Namely, a bit number usable in embedding the spatial information in the downmix signal is allocated per block.

In the description of the present invention, a block means a data unit inserted using one insertion bit length (i.e., K value) existing within a frame.

At least one or more blocks can exist within one frame. If a frame length is fixed, a block length may decrease according to the increment of the number of blocks.

Once the K value is determined, it is able to include the K value in a spatial information bitstream. Namely, a bitstream reshaping unit 305 is able to reshape the spatial information bitstream in a manner of enabling the spatial information bitstream to include the K value therein. In this case, a sync word, an error detection code, an error correction code and the like can be included in the spatial information bitstream.

The reshaped spatial information bitstream can be rearranged into an embeddable form. The rearranged spatial information bitstream is embedded in the downmix signal by an audio signal encoding unit 306 and is then outputted as an audio signal Lo'/Ro' 307 having the spatial information bitstream embedded therein. In this case, the spatial information bitstream can be embedded in K-bits of the downmix signal. The K value can have one fixed value in a block. In any cases, the K value is inserted in the spatial information bitstream in the reshaping or rearranging process of the spatial information bitstream and is then transferred to a decoding apparatus. And, the decoding apparatus is able to extract the spatial information bitstream using the K value.

As mentioned in the foregoing description, the spatial information bitstream goes through a process of being embedded in the downmix signal per block. The process is performed by one of various methods.

A first method is carried out in a manner of substituting lower K bits of the downmix signal with zeros simply and adding the rearranged spatial information bitstream data. For instance, if a K value is 3, if sample data of a downmix signal is 11101101 and if spatial information bitstream data to embed is 111, lower 3 bits of '11101101' are substituted with zeros to provide 11101000. And, the spatial information bitstream data '111' is added to '11101000' to provide '11101111'.

A second method is carried out using a dithering method. First of all, the rearranged spatial information bitstream data is subtracted from an insertion area of the downmix signal. The downmix signal is then re-quantized based on the K value. And, the rearranged spatial information bitstream data is added to the re-quantized downmix signal. For instance, if a K value is 3, if sample data of a downmix signal is 11101101 and if spatial information bitstream data to embed is 111, '111' is subtracted from the '11101101' to provide 11100110. Lower 3 bits are then re-quantized to provide '11101000' (by rounding off). And, the '111' is added to '11101000' to provide '11101111'.

Since a spatial information bitstream embedded in the downmix signal is a random bitstream, it may not have a white-noise characteristic. Since addition of a white-noise type signal to a downmix signal is advantageous in sound quality characteristics, the spatial information bitstream goes through a whitening process to be added to the downmix signal. And, the whitening process is applicable to spatial information bitstreams except a sync word.

In the present invention, 'whitening' means a process of making a random signal having an equal or almost similar sound quantity of an audio signal in all areas of a frequency domain.

Besides, in embedding a spatial information bitstream in a downmix signal, aural distortion can be minimized by applying a noise shaping method to the spatial information bitstream.

In the present invention, 'noise shaping method' means a process of modifying a noise characteristic to enable energy of a quantized noise generated from quantization to move to a high frequency band over an audible frequency band or a process of generating a time-varying filer corresponding to a masking threshold obtained from a corresponding audio signal and modifying a characteristic of a noise generated from quantization by the generated filter.

Figure 4:
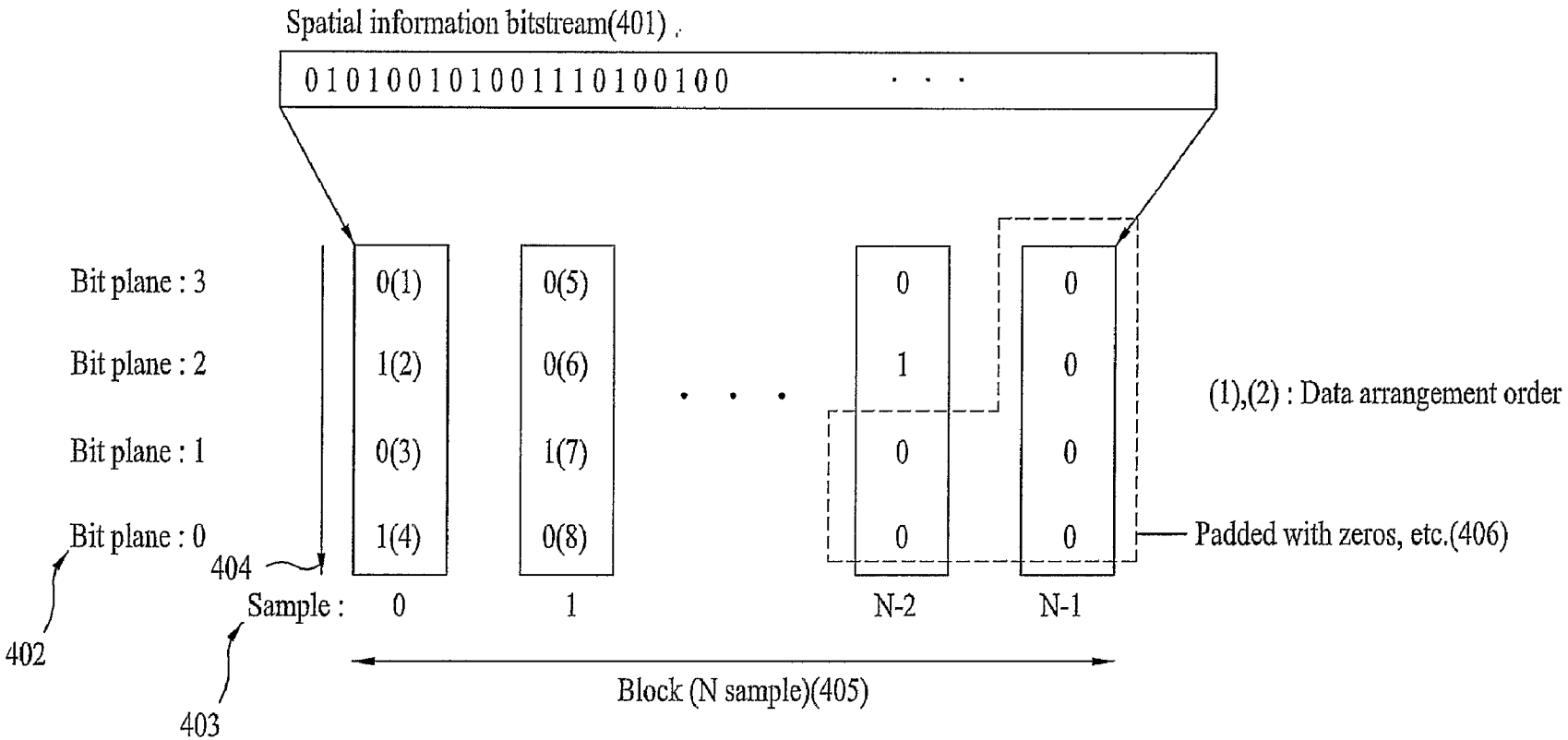
FIG. 4 is a diagram of a first method of rearranging a spatial information bitstream according to the present invention.

FIG. 4 is a diagram of a first method of rearranging a spatial information bitstream according to the present invention.

Referring to FIG. 4, as mentioned in the foregoing description, the spatial information bitstream can be rearranged into an embeddable form using the K value. In this case, the spatial information bitstream can be embedded in the downmix signal by being rearranged in various ways. And, FIG. 4 shows a method of embedding the spatial information in a sample plane order.

The first method is a method of rearranging the spatial information bitstream in a manner of dispersing the spatial information bitstream for a corresponding block by K-bit unit and embedding the dispersed spatial information bitstream sequentially.

If a K value is 4 and if one block 405 is constructed with N samples 403, the spatial information bitstream 401 can be rearranged to be embedded in lower 4 bits of each sample sequentially.

As mentioned in the foregoing description, the present invention is not limited to a case of embedding a spatial information bitstream in lower 4 bits of each sample.

Besides, in lower K bits of each sample, the spatial information bitstream, as shown in the drawing, can be embedded in MSB (most significant bit) first or LSB (least significant bit) first.

In FIG. 4, an arrow 404 indicates an embedding direction and a numeral within parentheses indicates a data rearrangement sequence.

A bit plane indicates a specific bit layer constructed with a plurality of bits.

In case that a bit number of a spatial information bitstream to be embedded is smaller than an embeddable bit number in an insertion area in which the spatial information bitstream will be embedded, remaining bits are padded up with zeros 406, a random signal is inserted in the remaining bits, or the remaining bits can be replaced by an original downmix signal.

For instance, if a number (N) of samples configuring a block is 100 and if a K value is 4, a bit number (W) embeddable in the block is $W=N*K=100*4=400$.

If a bit number (V) of a spatial information bitstream to be embedded is 390 bits (i.e., $V<W$), remaining 10 bits are padded up with zeros, a random signal is inserted in the remaining 10 bits, or the remaining 10 bits are replaced by an original downmix signal, the remaining 10 bits are filled up with a tail sequence indicating a data end, or the remaining 10 bits can be filled up with combinations of them. The tail sequence means a bit sequence indicating an end of a spatial information bitstream in a corresponding block. Although FIG. 4 shows that the remaining bits are padded per block, the present invention includes a case that the remaining bits are padded up per insertion frame in the above manner.

Figure 5:
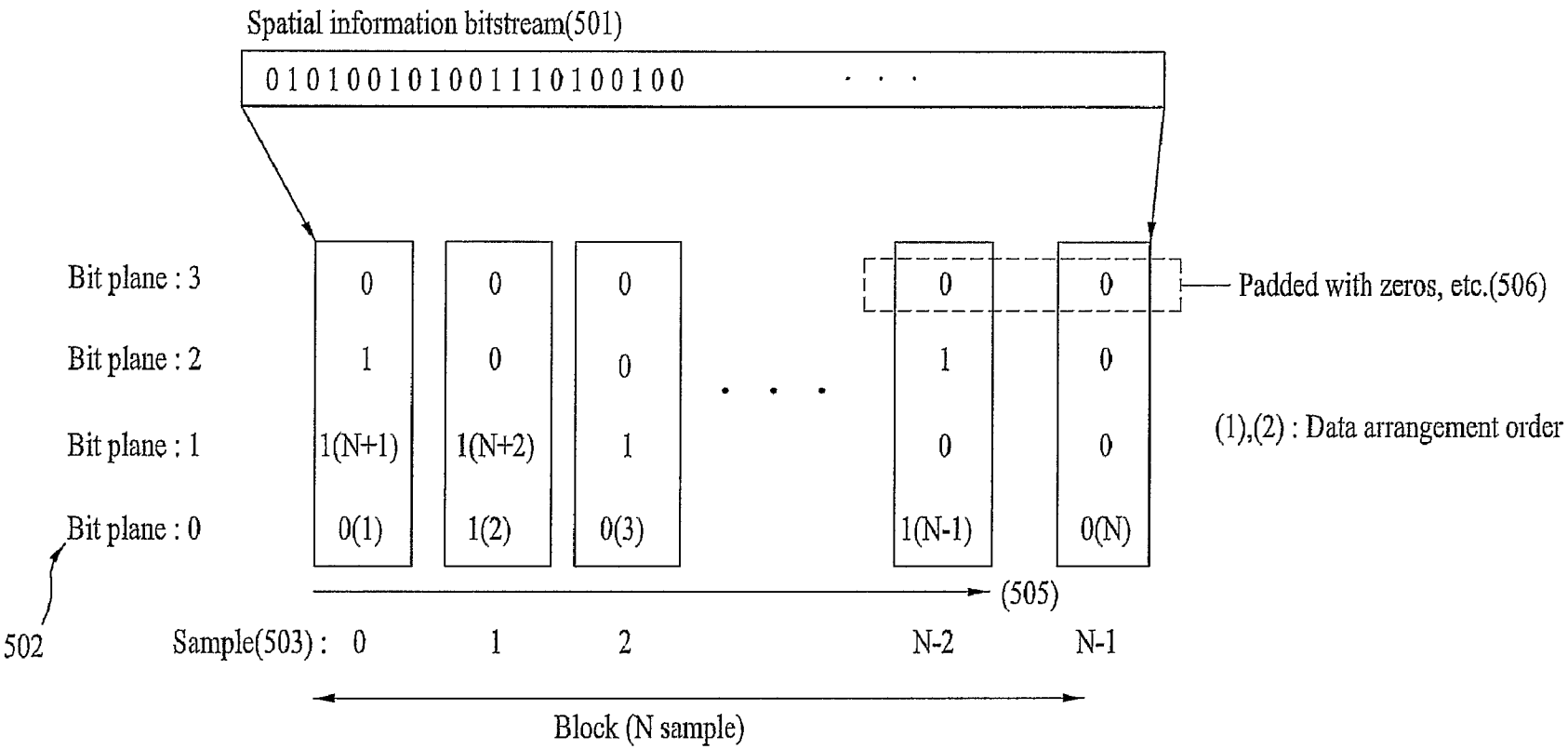
FIG. 5 is a diagram of a second method of rearranging a spatial information bitstream according to the present invention.

FIG. 5 is a diagram of a second method of rearranging a spatial information bitstream according to the present invention.

Referring to FIG. 5, the second method is carried out in a manner of rearranging a spatial information bitstream 501 in a bit plane 502 order. In this case, the spatial information bitstream can be sequentially embedded from a lower bit of a downmix signal per block, which does not put limitation of the present invention.

For instance, if a number (N) of samples configuring a block is 100 and if a K value is 4, 100 least significant bits configuring the bit plane-0 502 are preferentially padded and 100 bits configuring the bit plane-1 502 can be padded.

In FIG. 5, an arrow 505 indicates an embedding direction and a numeral within parentheses indicates a data rearrangement order.

The second method can be specifically advantageous in extracting a sync word at a random position. In searching for the sync word of the inserted spatial information bitstream from the rearranged and encoded signal, only LSB can be extracted to search for the sync word.

And, it can be expected that the second method uses minimum LSB only according to a bit number (V) of a spatial information bitstream to be embedded. In this case, if a bit number (V) of a spatial information bitstream to be embedded is smaller than an embeddable bit number (W) in an insertion area in which the spatial information bitstream will be embedded, remaining bits are padded up with zeros 506, a random signal is inserted in the remaining bits, the remaining bits are replaced by an original downmix signal, the remaining bits are padded with an end bit sequence indicating an end of data, or the remaining bits can be padded with combinations of them. In particular, the method of using the downmix signal is advantageous. Although, FIG. 5 shows an example of padding the remaining bits per block, the present invention includes a case of padding the remaining bits per insertion frame in the above-explained manner.

Figure 6A:
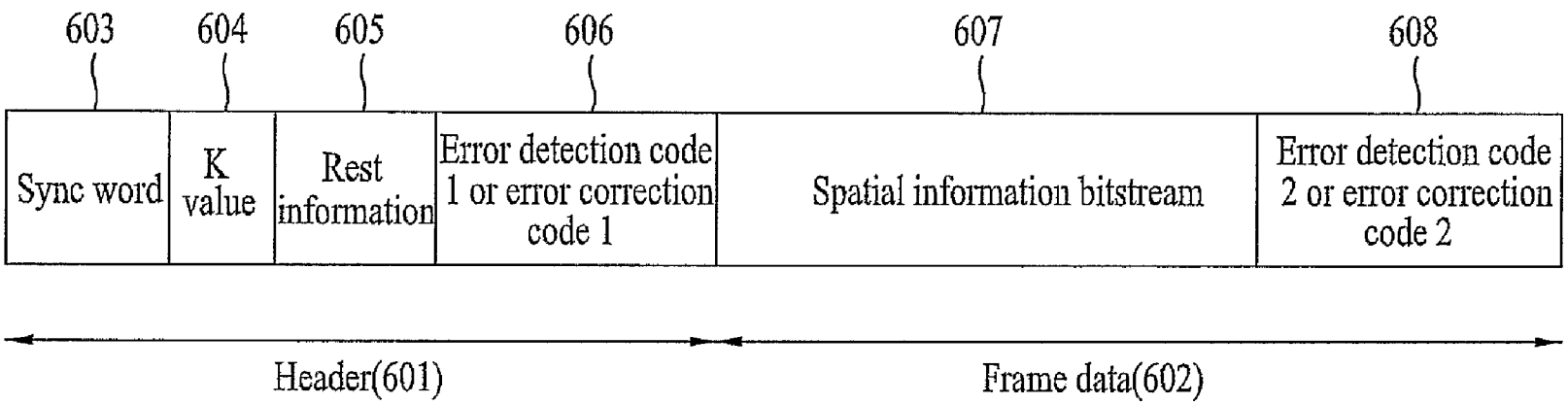
FIG. 6A is a diagram of a reshaped spatial information bitstream according to the present invention.

FIG. 6A shows a bitstream structure to embed a spatial information bitstream in a downmix signal according to the present invention.

Referring to FIG. 6A, a spatial information bitstream 607 can be rearranged by the bitstream reshaping unit 305 to include a sync word 603 and a K value 604 for the spatial information bitstream.

And, at least one error detection code or error correction code 606 or 608 (hereinafter, the error detection code will be described) can be included in the reshaped spatial information bitstream in the reshaping process. The error detection code is capable of deciding whether the spatial information bitstream 607 is distorted in a process of transmission or storage The error detection code includes CRC (cyclic redundancy check). The error detection code can be included by being divided into two steps. An error detection code-1 for a header 601 having K values and an error detection code-2 for a frame data 602 of the spatial information bitstream can be separately included in the spatial information bitstream. Besides, the rest information 605 can be separately included in the spatial information bitstream. And, information for a rearrangement method of the spatial information bitstream and the like can be included in the rest information 605.

Figure 6B:
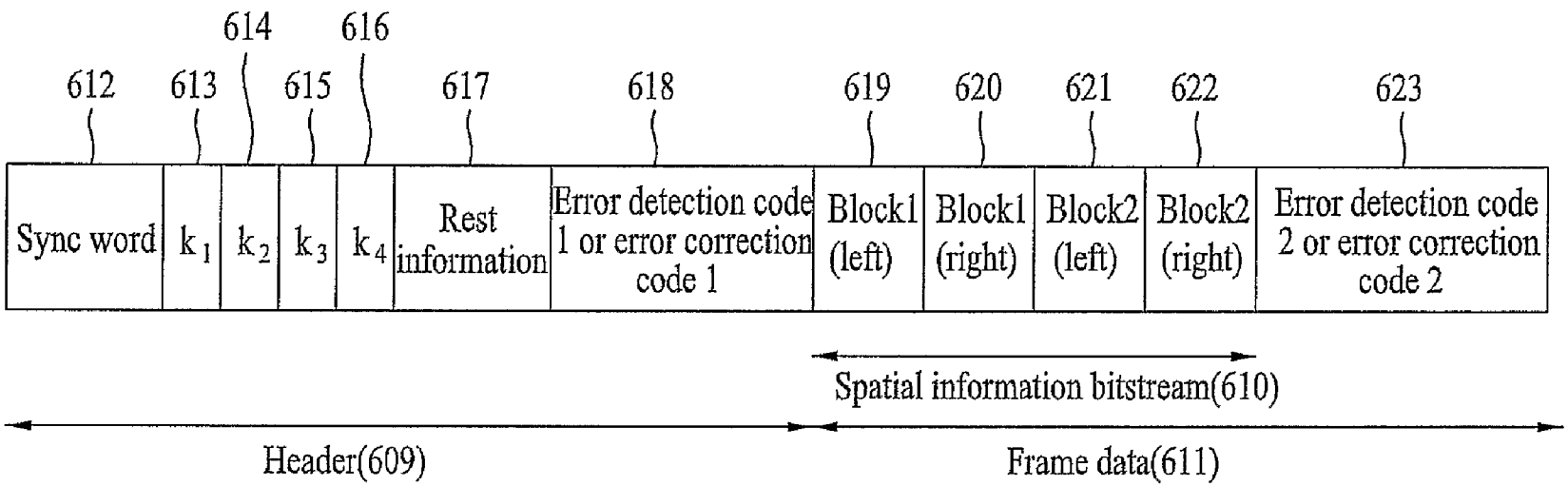
FIG. 6B is a detailed diagram of a configuration of the spatial information bitstream shown in FIG. 6A.

FIG. 6B is a detailed diagram of a configuration of the spatial information bitstream shown in FIG. 6A. FIG. 6B shows an embodiment that one frame of a spatial information bitstream 601 includes two blocks, to which the present invention is not limited.

Referring to FIG. 6B, a spatial information bitstream shown in FIG. 6B includes a sync word 612, K values (K1, K2, K3, K4) 613 to 616, a rest information 617 and error detection codes 618 and 623.

The spatial information bitstream 610 includes a pair of blocks. In case of a stereo signal, a block-1 can be consist of blocks 619 and 620 for left and right channels, respectively. And, a block-2 can be consist of blocks 621 and 62 for left and right channels, respectively.

Although a stereo signal is shown in FIG. 6B, the present invention is not limited to the stereo signal.

Insertion bit lengths (K values) for the blocks are included in a header part.

The K1 613 indicates the insertion bit length for the left channel of the block-1. The K2 614 indicates the insertion bit length of the right channel of the block-1. The K3 615 indicates the insertion bit length for the left channel of the block-2. And, the K4 616 indicates the insertion bit size for the right channel of the block-2.

And, the error detection code can be included by being divided into two steps. For instance, an error detection code-1 618 for a header 609 including the K values therein and an error detection code-2 for a frame data 611 of the spatial information bitstream can be separately included.

Figure 7:
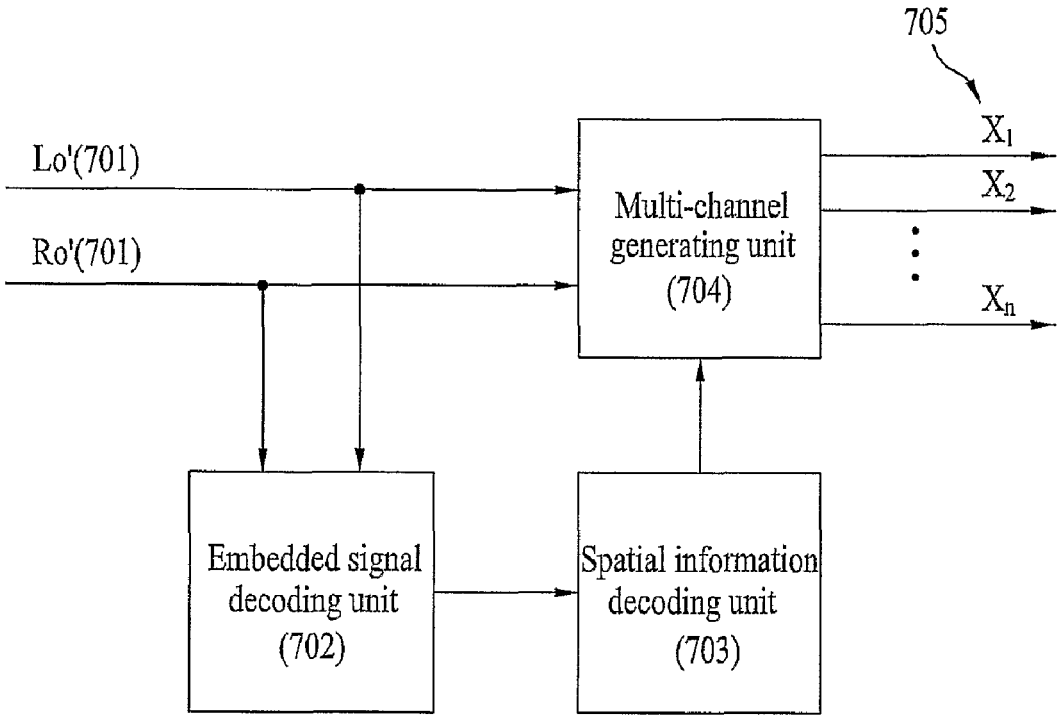
FIG. 7 is a block diagram of a spatial decoder according to the present invention.

FIG. 7 is a block diagram of a decoding apparatus according to the present invention.

Referring to FIG. 7, a decoding apparatus according to the present invention receives an audio signal Lo'/Ro' 701 in which a spatial information bitstream is embedded.

The audio signal having the spatial information bitstream embedded therein may be one of mono, stereo and multi-channel signals. For the convenience of explanation, the stereo signal is taken as an example of the present invention, which does not put limitation on the present invention.

An embedded signal decoding unit 702 is able to extract the spatial information bitstream from the audio signal 701.

The spatial information bitstream extracted by the embedded signal decoding unit 702 is an encoded spatial information bitstream. And, the encoded spatial information bitstream can be an input signal to a spatial information decoding unit 703.

The spatial information decoding unit 703 decodes the encoded spatial information bitstream and then outputs the decoded spatial information bitstream to a multi-channel generating unit 704.

The multi-channel generating unit 704 receives the downmix signal 701 and spatial information obtained from the decoding as inputs and then outputs the received inputs as a multi-channel audio signal 705.

Figure 8:
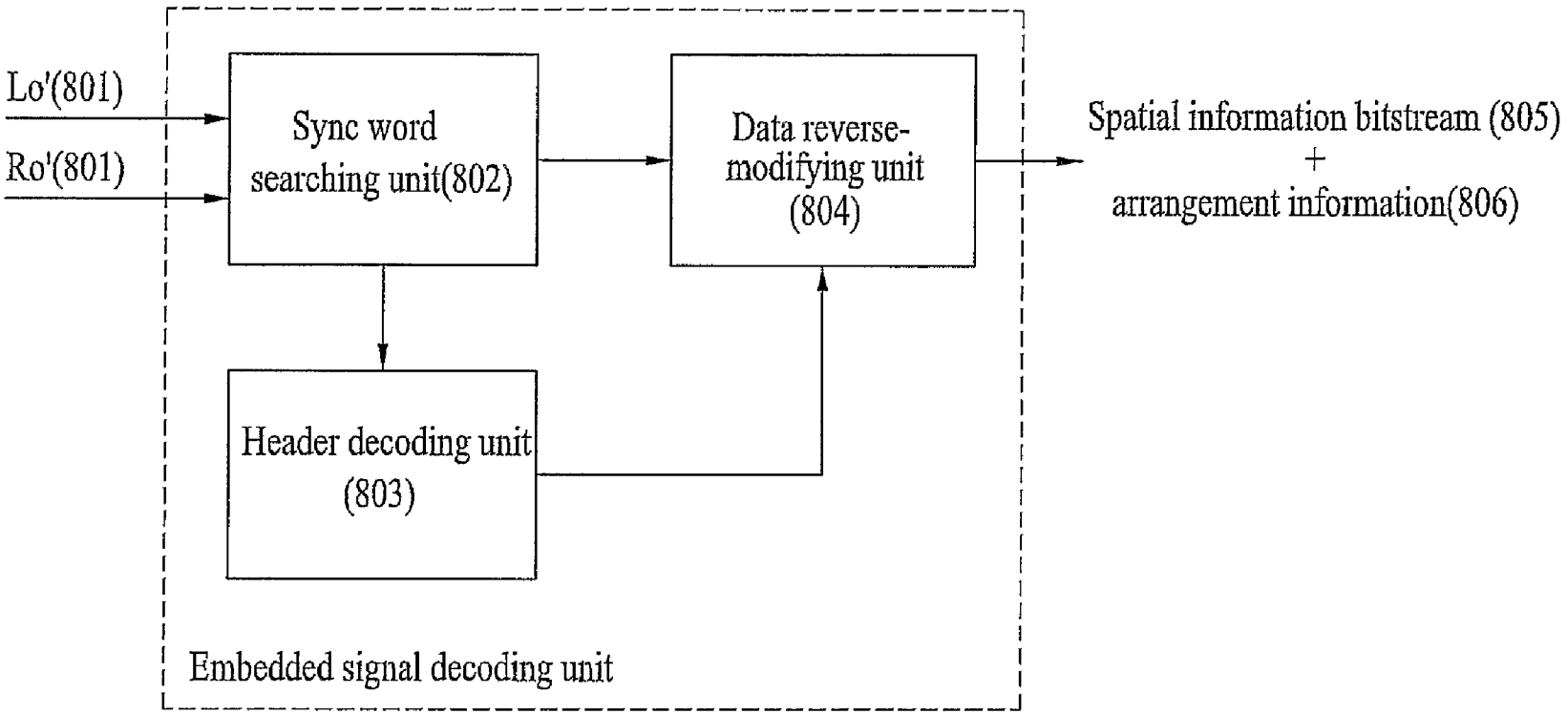
FIG. 8 is a detailed block diagram of an embedded signal decoder included in the spatial decoder according to the present invention.

FIG. 8 is a detailed block diagram of the embedded signal decoding unit 702 configuring the decoding apparatus according to the present invention.

Referring to FIG. 8, an audio signal Lo'/Ro', in which spatial information is embedded, is inputted to the embedded signal decoding unit 702. And, a sync word searching unit 802 detects a sync word from the audio signal 801. In this case, the sync word can be detected from one channel of the audio signal.

After the sync word has been detected, a header decoding unit 803 decodes a header area. In this case, information of a predetermined length is extracted from the header area and a data reverse-modifying unit 804 is able to apply an reverse-whitening scheme to header area information excluding the sync word from the extracted information.

Subsequently, length information of the header area and the like can be obtained from the header area information having the reverse-whitening scheme applied thereto.

And, the data reverse-modifying unit 804 is able to apply the reverse-whitening scheme to the rest of the spatial information bitstream. Information such as a K value and the like can be obtained through the header decoding. An original spatial information bitstream can be obtained by arranging the rearranged spatial information bitstream again using the information such as K value and the like. Moreover, sync position information for arranging frames of a downmix signal and the spatial information bitstream, i.e., a frame arrangement information 806 can be obtained.

Figure 9:
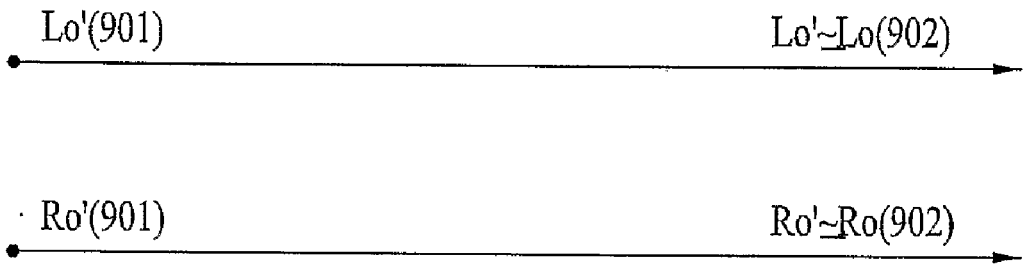
FIG. 9 is a diagram for explaining a case that a general PCM decoder reproduces an audio signal according to the present invention.

FIG. 9 is a diagram for explaining a case that a general PCM decoding apparatus reproduces an audio signal according to the present invention.

Referring to FIG. 9, an audio signal Lo'/Ro', in which a spatial information bitstream is embedded, is applied as an input of a general PCM decoding apparatus.

The general PCM decoding apparatus recognizes the audio signal Lo'/Ro', in which a spatial information bitstream is embedded, as a normal stereo audio signal to reproduce a sound. And, the reproduced sound is not discriminated from an audio signal 902 prior to the embedment of spatial information in aspect of quality of sound.

Hence, the audio signal, in which the spatial information is embedded, according to the present invention has compatibility for normal reproduction of stereo signals in the general PCM decoding apparatus and an advantage in providing a multi-channel audio signal in a decoding apparatus capable of multi-channel decoding.

Figure 10:
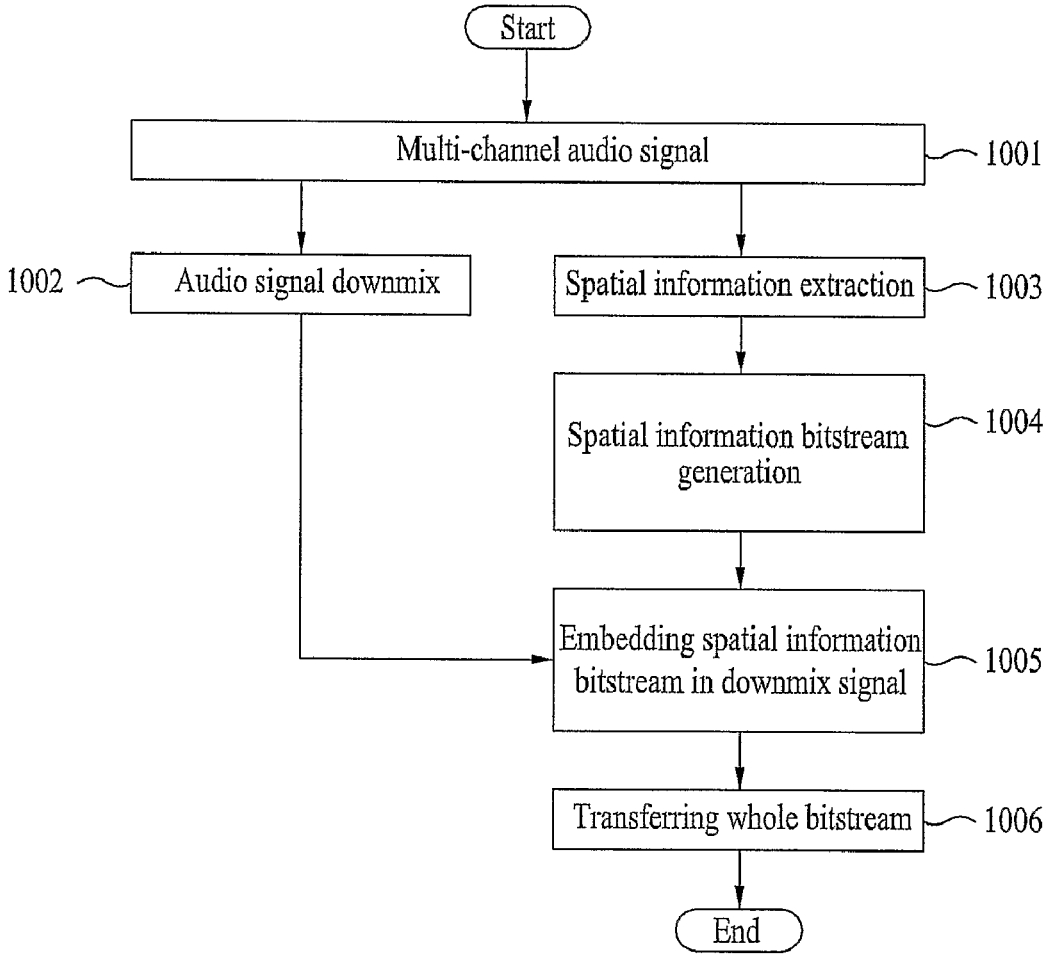
FIG. 10 is a flowchart of an encoding method for embedding spatial information in a downmix signal according to the present invention.

FIG. 10 is a flowchart of an encoding method for embedding spatial information in a downmix signal according to the present invention.

Referring to FIG. 10, an audio signal is downmixed from a multi-channel signal (1001, 1002). In this case, the downmix signal can be one of mono, stereo and multi-channel signals.

Subsequently, spatial information is extracted from the multi-channel signal (1003). And, a spatial information bitstream is generated using the spatial information (1004).

The spatial information bitstream is embedded in the downmix signal (1005).

And, a whole bitstream including the downmix signal having the spatial information bitstream embedded therein is transferred to a decoding apparatus (1006).

In particular, the present invention finds an insertion bit length (i.e., K value) of an insertion area, in which the spatial information bitstream will be embedded, using the downmix signal and may embed the spatial information bitstream in the insertion area.

Figure 11:
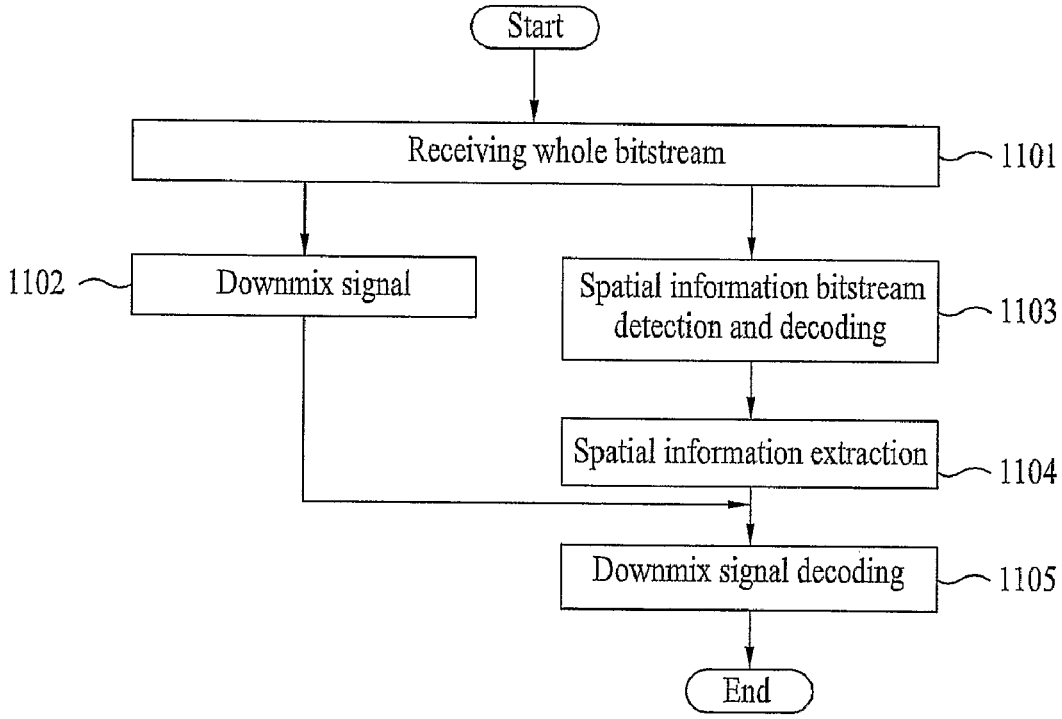
FIG. 11 is a flowchart of a method of decoding spatial information embedded in a downmix signal according to the present invention.

FIG. 11 is a flowchart of a method of decoding spatial information embedded in a downmix signal according to the present invention.

Referring to FIG. 11, a decoding apparatus receives a whole bitstream including a downmix signal having a spatial information bitstream embedded therein (1101) and extract the downmix signal from the bitstream (1102).

The decoding apparatus extracts and decodes the spatial information bitstream from the whole bitstream (1103).

The decoding apparatus extracts spatial information through the decoding (1104) and then decodes the downmix signal using the extracted spatial information (1105). In this case, the downmix signal can be decoded into two channels or multi-channels.

In particular, the present invention can extract information for an embedding method of the spatial information bitstream and information of a K value and can decode the spatial information bitstream using the extracted embedding method and the extracted K value.

Figure 12:
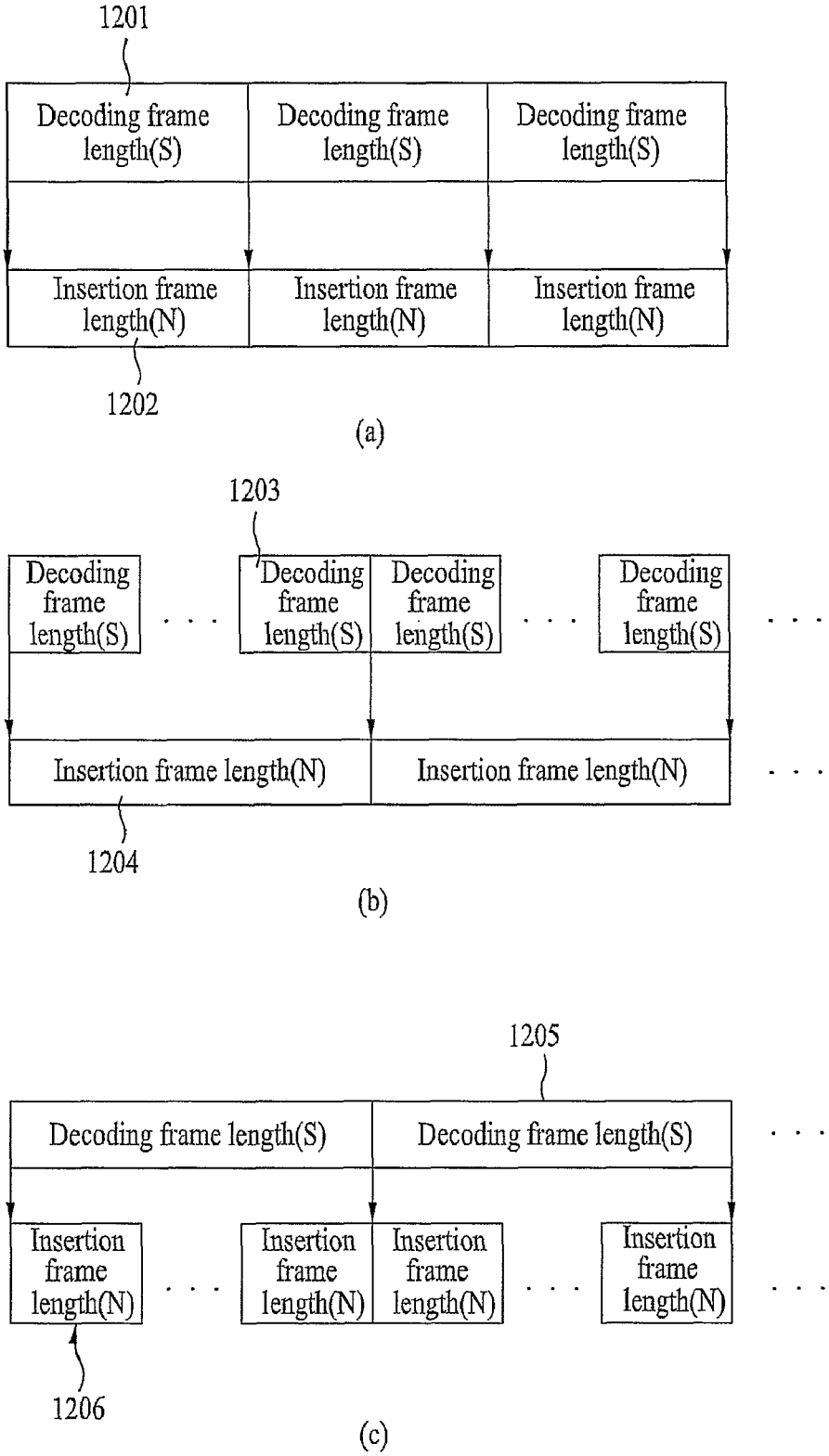
FIG. 12 is a diagram for a frame size of a spatial information bitstream embedded in a downmix signal according to the present invention.

FIG. 12 is a diagram for a frame length of a spatial information bitstream embedded in a downmix signal according to the present invention.

Referring to FIG. 12, a 'frame' means a unit having one header and enabling an independent decoding of a predetermined length. In the description of the present invention, a 'frame' means an 'insertion frame' that is going to come next. In the present invention, an 'insertion frame' means a unit of embedding a spatial information bitstream in a downmix signal.

And, a length of the insertion frame can be defined per frame or can use a predetermined length.

For instance, the insertion frame length is made to become a same length of a frame length (s) (hereinafter called 'decoding frame length) of a spatial information bitstream corresponding to a unit of decoding and applying spatial information (cf. (a) of FIG. 12), to become a multiplication of 'S' (cf. (b) of FIG. 12), or to enable 'S' to become a multiplication of 'N' (cf. (c) of FIG. 12).

In case of N=S, as shown in (a) of FIG. 12, the decoding frame length (S, 1201) coincides with the insertion frame length (N, 1202) to facilitate a decoding process.

In case of N>S, as shown in (b) of FIG. 12, it is able to reduce a number of bits attached due to a header, an error detection code (e.g., CRC) or the like in a manner of transferring one insertion frame (N, 1204) by attaching a plurality of decoding frames (1203) together.

In case of N<S, as shown in (c) of FIG. 12, it is able to configure one decoding frame (S, 1205) by attaching several insertion frames (N, 1206) together.

In the insertion frame header, information for an insertion bit length for embedding spatial information therein, information for the insertion frame length (N), information for a number of subframes included in the insertion frame or the like can be inserted.

Figure 13:
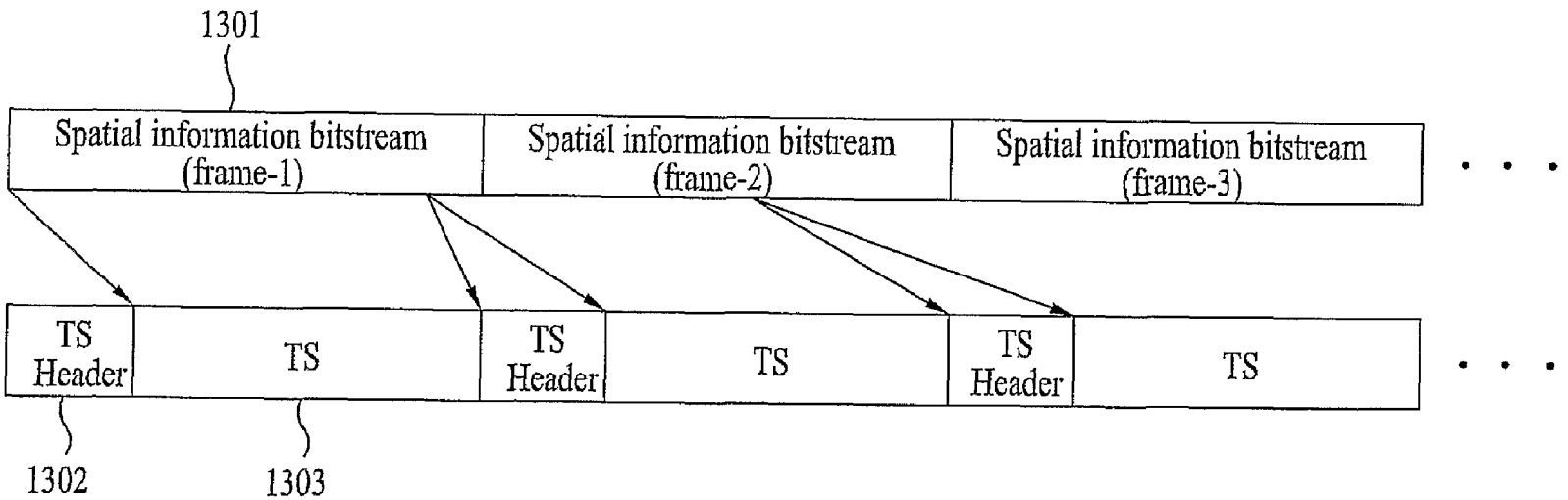
FIG. 13 is a diagram of a spatial information bitstream embedded by a fixed size in a downmix signal according to the present invention.

FIG. 13 is a diagram of a spatial information bitstream embedded in a downmix signal by an insertion frame unit according to the present invention.

First of all, in each of the cases shown in (a), (b) and (c) of FIG. 12, the insertion frame and the decoding frame are configured to be a multiplication from each other.

Referring to FIG. 13, for transferring, it is able to configure a bitstream of a fixed length, e.g., an packet in such a format as a transport stream (TS) 1303.

In particular, a spatial information bitstream 1301 can be bound by a packet unit of a predetermined length regardless of a decoding frame length of the spatial information bitstream. The packet in which information such as a TS header 1302 and like is inserted can be transferred to a decoding apparatus. A length of the insertion frame can be defined per frame or can use a predetermined length instead of being defined within a frame.

This method is necessary to vary a data rate of a spatial information bitstream by considering that a masking threshold differs per block according to characteristics of a downmix signal and a maximum bit number (K_max) that can be allocated without sound quality distortion of the downmix signal is different.

For instance, in case that the K_max is insufficient to entirely represent a spatial information bitstream needed by a corresponding block, data is transferred up to K_max and the rest is transferred later via another block.

In the K_max is sufficient, a spatial information bitstream for a next block can be loaded in advance.

In this case, each TS packet has an independent header. And, a sync word, TS packet length information, information for a number of subframes included in TS packet, information for insertion bit length allocated within a packet or the like can be included in the header.

Figure 14A:
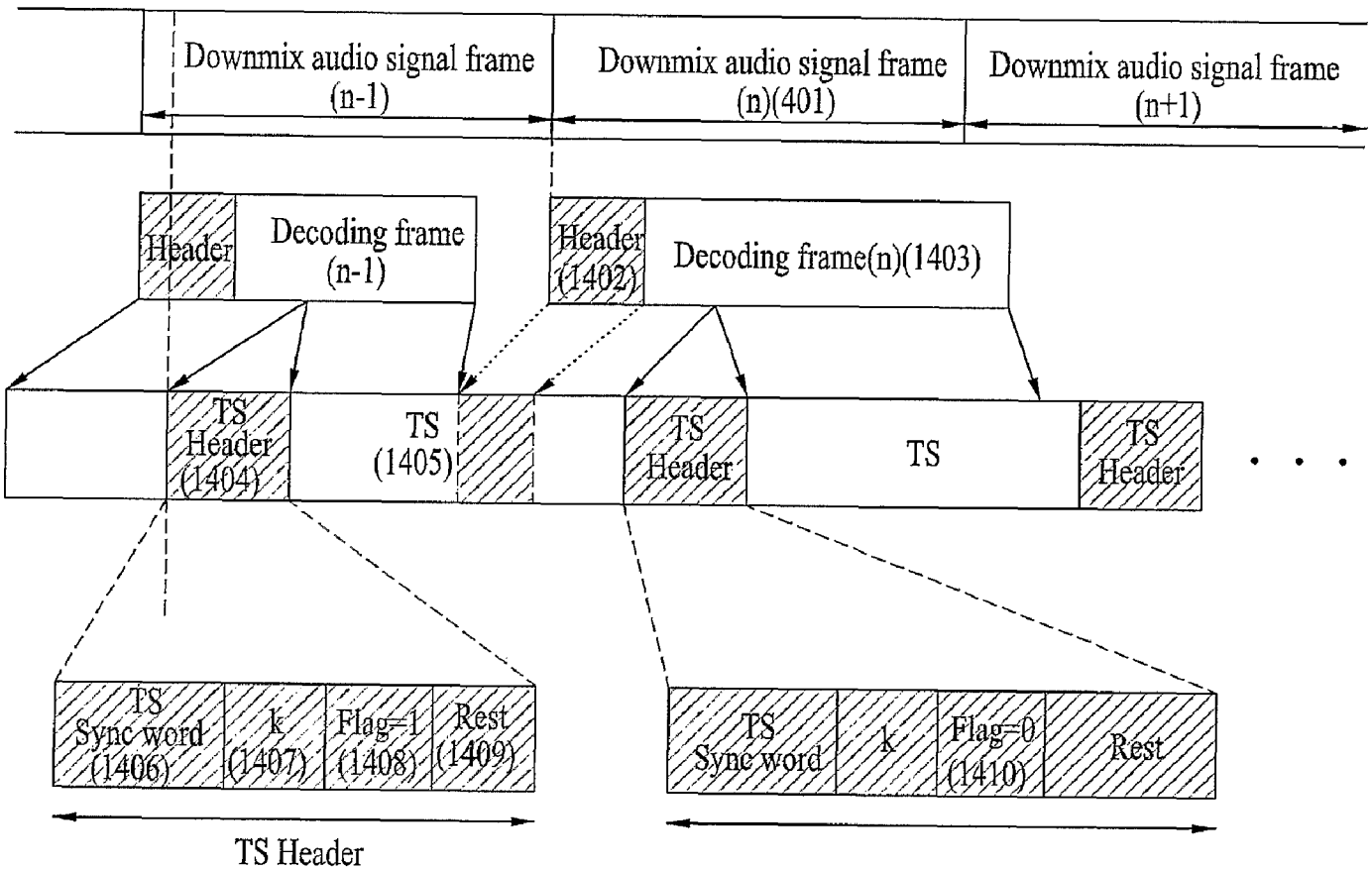
FIG. 14A is a diagram for explaining a first method for solving a time align problem of a spatial information bitstream embedded by a fixed size.

FIG. 14A is a diagram for explaining a first method for solving a time align problem of a spatial information bitstream embedded by an insertion frame unit.

Referring to FIG. 14A, a length of an insertion frame is defined per frame or can use a predetermined length.

An embedding method by an insertion frame unit may cause a problem of a time alignment between an insertion frame start position of an embedded spatial information bitstream and a downmix signal frame. So, a solution for the time alignment problem is needed.

In the first method shown in FIG. 14A, a header 1402 (hereinafter called 'decoding frame header') for a decoding frame 1403 of spatial information is separately placed.

Discriminating information indicating whether there exists position information of an audio signal to which the spatial information will be applied can be included within the decoding frame header 1402.

For instance, in case of a TS packet 1404 and 1405, a discriminating information 1408 (e.g., flag) indicating whether there exists the decoding frame header 1402 can be included in the TS packet header 1404.

If the discriminating information 1408 is 1, i.e., if the decoding frame header 1402 exists, the discriminating information indicating whether position information of a downmix signal to which the spatial information bitstream will be applied can be extracted from the decoding frame header.

Subsequently, position information 1409 (e.g., delay information) for the downmix signal to which the spatial information bitstream will be applied, can be extracted from the decoding frame header 1402 according to the extracted discriminating information.

If the discriminating information 1411 is 0, the position information may not be included within the header of the TS packet.

In general, the spatial information bitstream 1403 preferably comes ahead of the corresponding downmix signal 1401. So, the position information 1409 could be a sample value for a delay.

Meanwhile, in order to prevent a problem that a quantity of information necessary for representing the sample value excessively increases due to the delay that is excessively large, a sample group unit (e.g., granule unit) for representation of a group of samples or the like is defined. So, the position information can be represented by the sample group unit.

As mentioned in the foregoing description, a TS sync word 1406, an insertion bit length 1407, the discriminating information indicating whether there exists the decoding frame header and the rest information 140 can be included within the TS header.

Figure 14B:
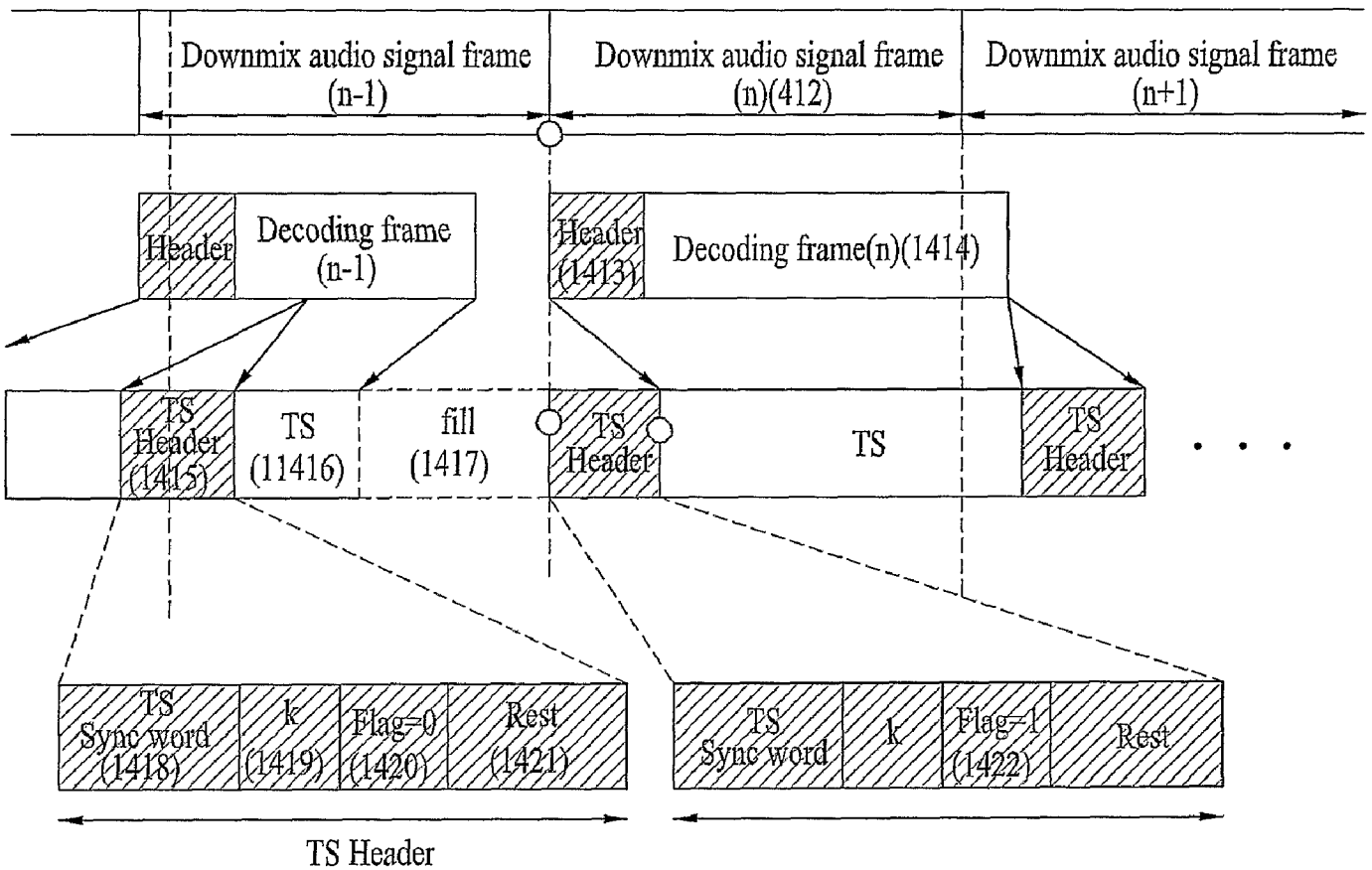
FIG. 14B is a diagram for explaining a second method for solving a time align problem of a spatial information bitstream embedded by a fixed size.

FIG. 14B is a diagram for explaining a second method for solving a time align problem of a spatial information bitstream embedded by an insertion frame having a length defined per frame.

Referring to FIG. 14B, in case of a TS packet for example, the second method is carried out in a manner of matching a start point 1413 of a decoding frame, a start point of the TS packet and a start point of a corresponding downmix signal 1412.

For the matched part, discriminating information 1420 or 1422 (e.g., flag) indicating that the three kinds of the start points are aligned can be included within a header 1415 of the TS packet.

FIG. 14B shows that the three kinds of start points are matched at an $n^{th}$ frame 1412 of a downmix signal. In this case, the discriminating information 1422 can have a value of 1.

If the three kinds of start points are not matched, the discriminating information 1420 can have a value of 0.

To match the three kinds of the start points together, a specific portion 1417 next to a previous TS packet is padded up with zeros, has a random signal inserted therein, is replaced by an originally downmixed audio signal or is padded up with combinations of them.

As mentioned in the foregoing description, a TS sync word 1418, an insertion bit length 1419 and the rest information 1421 can be included within the TS packet header 1415.

Figure 15:
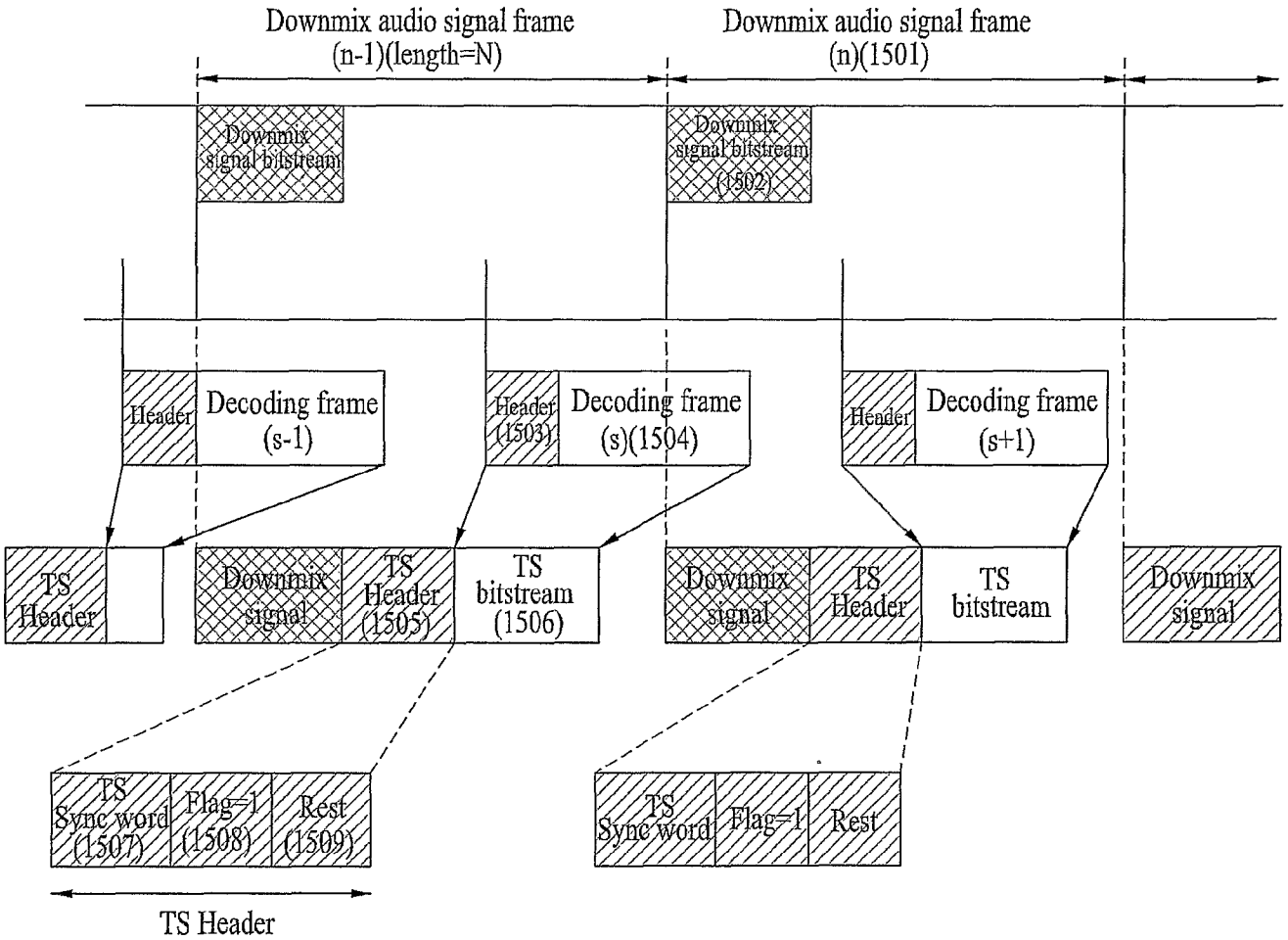
FIG. 15 is a diagram of a method of attaching a spatial information bitstream to a downmix signal according to the present invention.

FIG. 15 is a diagram of a method of attaching a spatial information bitstream to a downmix signal according to the present invention.

Referring to FIG. 15, a length of a frame (hereinafter called 'attaching frame') to which a spatial information bitstream is attached can be a length unit defined per frame or a predetermined length unit not defined per frame.

For instance, an insertion frame length, as shown in the drawing, can be obtained by multiplying or dividing a decoding frame length 1504 of spatial information with N, wherein N is a positive integer or the insertion frame length can have a fixed length unit.

If the decoding frame length 1504 is different from the insertion frame length, it is able to generate the insertion frame having the same length as the decoding frame length 1504, for example, without segmenting the spatial information bitstream instead of cutting the spatial information bitstream randomly to be fitted into the insertion frame.

In this case, the spatial information bitstream can be configured to be embedded in a downmix signal or can be configured to be attached to the downmix signal instead of being embedded in the downmix signal.

In such a signal (hereinafter called a 'first audio signal') as a PCM signal, which is converted to a digital signal from an analog signal, the spatial information bitstream can be configured to be embedded in the first audio signal.

In such a more compressed digital signal (hereinafter called a 'second audio signal') as an MP3 signal, the spatial information bitstream can be configured to be attached to the second audio signal.

In case of using the second audio signal, for example, the downmix signal can be represented as a bitstream in a compressed format. So, a downmix signal bitstream 1502, as shown in the drawing, exists in a compressed format and the spatial information of the decoding frame length 1504 can be attached to the downmix signal bitstream 1502.

Hence, the spatial information bitstream can be transferred at a burst.

A header 1503 can exist in the decoding frame. And, position information of a downmix signal to which spatial information is applied can be included in the header 1503.

Meanwhile, the present invention includes a case that the spatial information bitstream is configured into a attaching frame (e.g., TS bitstream 1506) in a compressed format to attach the attaching frame to the downmix signal bitstream 1502 in the compressed format.

In this case, a TS header 1505 for the TS bitstream 1506 can exist. And, at least one of attaching frame sync information 1507, discriminating information 1508 indicating whether a header of a decoding frame exists within the attaching frame, information for a number of subframes included in the attaching frame and the rest information 1509 can be included in the attaching frame header (e.g., TS header 1505). And, discriminating information indicating whether a start point of the attaching frame and a start point of the decoding frame are matched can be included within the attaching frame.

If the decoding frame header exists within the attaching frame, discriminating information indicating whether there exists position information of a downmix signal to which the spatial information is applied is extracted from the decoding frame header.

Subsequently, the position information of the downmix signal, to which the spatial information is applied, can be extracted according to the discriminating information.

Figure 16:
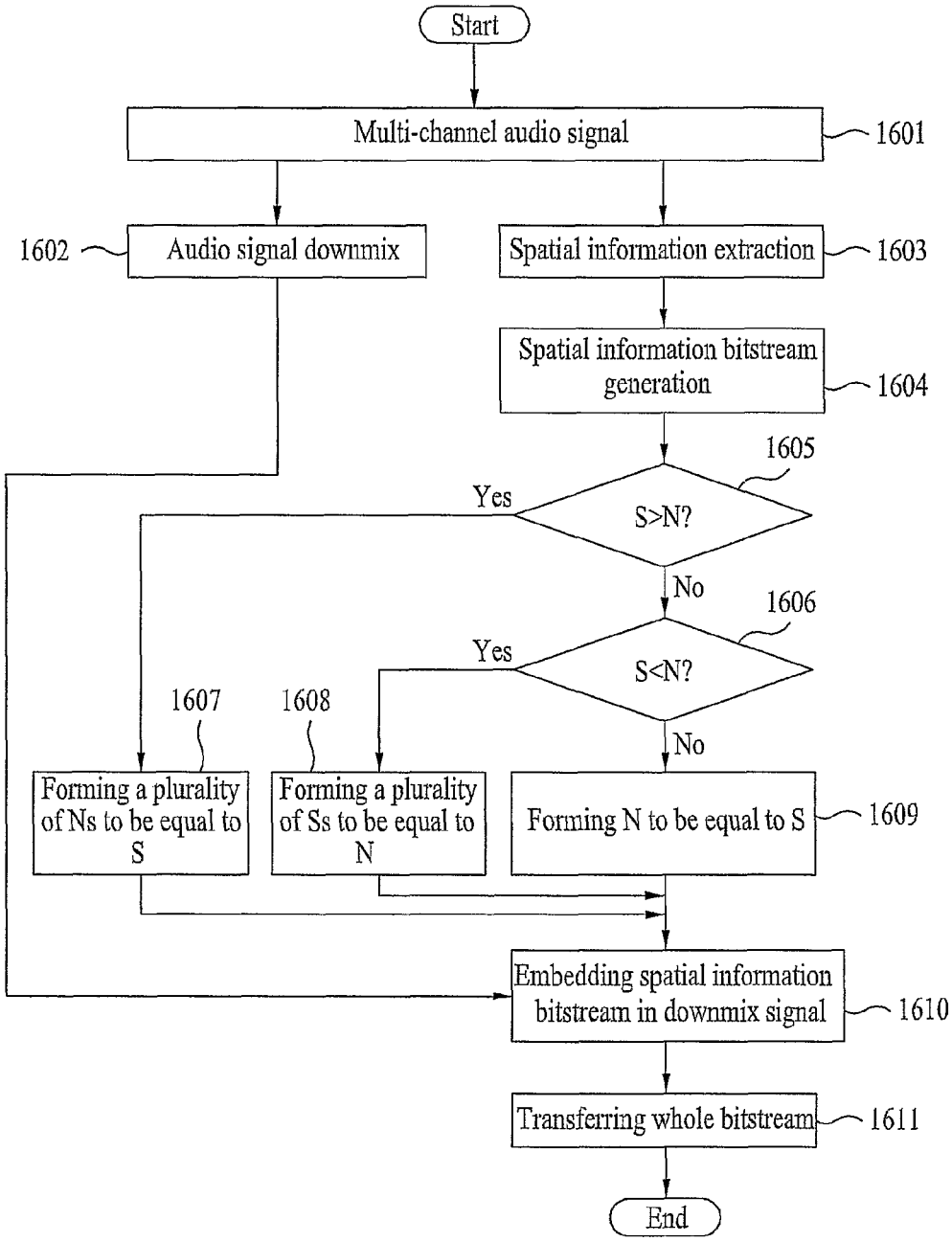
FIG. 16 is a flowchart of a method of encoding a spatial information bitstream embedded by various sizes in a downmix signal according to the present invention.

FIG. 16 is a flowchart of a method of encoding a spatial information bitstream embedded in a downmix signal by insertion frames of various sizes according to the present invention.

Referring to FIG. 16, an audio signal is downmixed from a multi-channel audio signal (1601, 1602). In this case, the downmix signal may be a mono, stereo or multi-channel audio signal.

And, spatial information is extracted from the multi-channel audio signal (1601, 1603).

A spatial information bitstream is then generated using the extracted spatial information (1604). The generated spatial information can be embedded in the downmix signal by an insertion frame unit having a length corresponding to an integer multiplication of a decoding frame length per frame.

If a decoding frame length (S) is greater than a insertion frame length (N) (1605), the insertion frame length (N) is configured equal to one S by binding a plurality of Ns together (1607).

If the decoding frame length (S) is smaller than the insertion frame length (N) (1606), the insertion frame length (N) is configured equal to one N by binding a plurality of Ss together (1608).

If the decoding frame length (S) is equal to the insertion frame length (N), the insertion frame length (N) is configured equal to the decoding frame length (S) (1609).

The spatial information bitstream configured in the above-explained manner is embedded in the downmix signal (1610).

Finally, a whole bitstream including the downmix signal having the spatial information bitstream embedded therein is transferred (1611).

Besides, in the present invention, information for an insertion frame length of a spatial information bitstream can be embedded in a whole bitstream.

Figure 17:
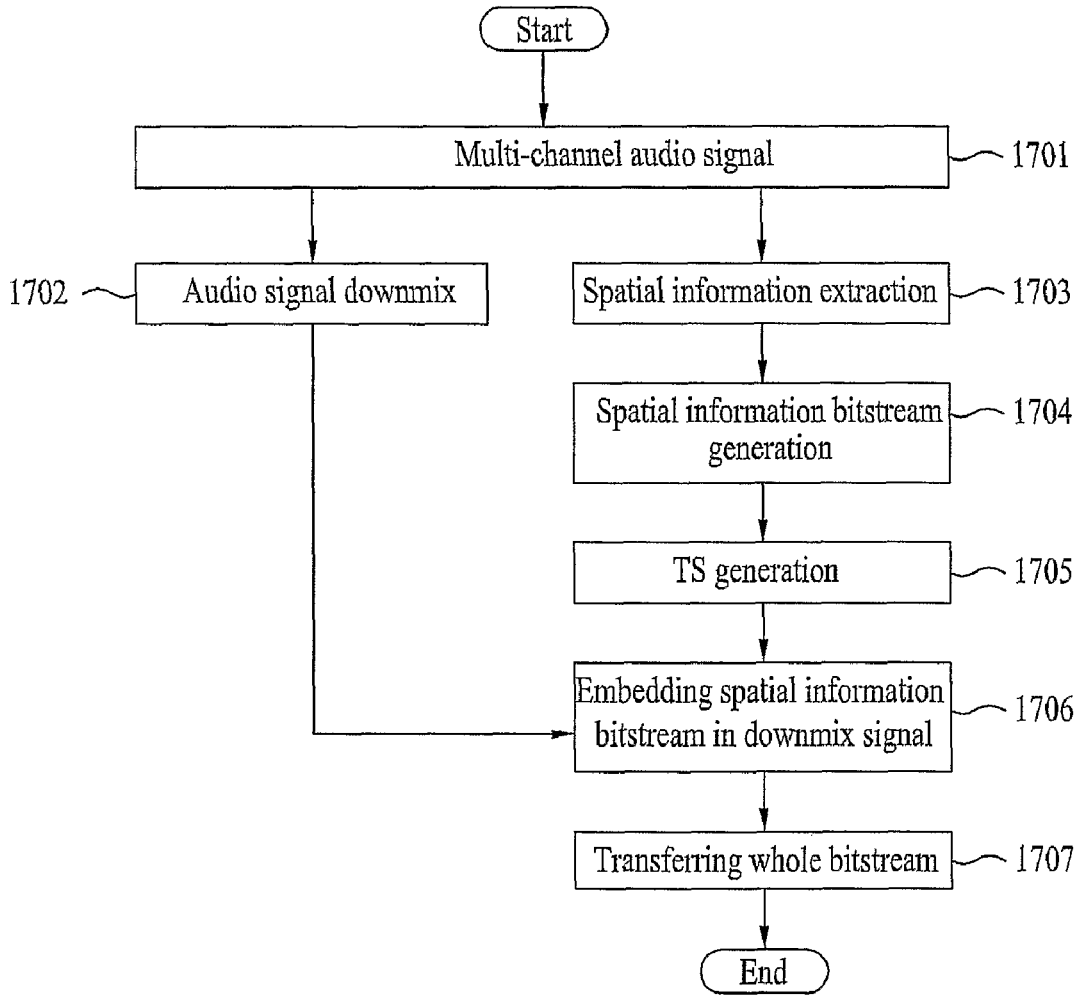
FIG. 17 is a flowchart of a method of encoding a spatial information bitstream embedded by a fixed size in a downmix signal according to the present invention.

FIG. 17 is a flowchart of a method of encoding a spatial information bitstream embedded by a fixed length in a downmix signal according to the present invention.

Referring to FIG. 17, an audio signal is downmixed from a multi-channel audio signal (1701, 1702). In this case, the downmix signal may be a mono, stereo or a multi-channel audio signal.

And, spatial information is extracted from the multi-channel audio signal (1701, 1703).

A spatial information bitstream is then generated using the extracted spatial information (1704).

After the spatial information bitstream has been bound into a bitstream having a fixed length (packet unit), e.g., a transport stream (TS) (1705), the spatial information bitstream of the fixed length is embedded in the downmix signal (1706).

Subsequently, a whole bitstream including the downmix signal having the spatial information bitstream embedded therein is transferred (1707).

Besides, in the present invention, an insertion bit length (i.e., K value) of an insertion area, in which the spatial information bitstream is embedded, is obtained using the downmix signal and the spatial information bitstream can be embedded in the insertion area.

Figure 18:
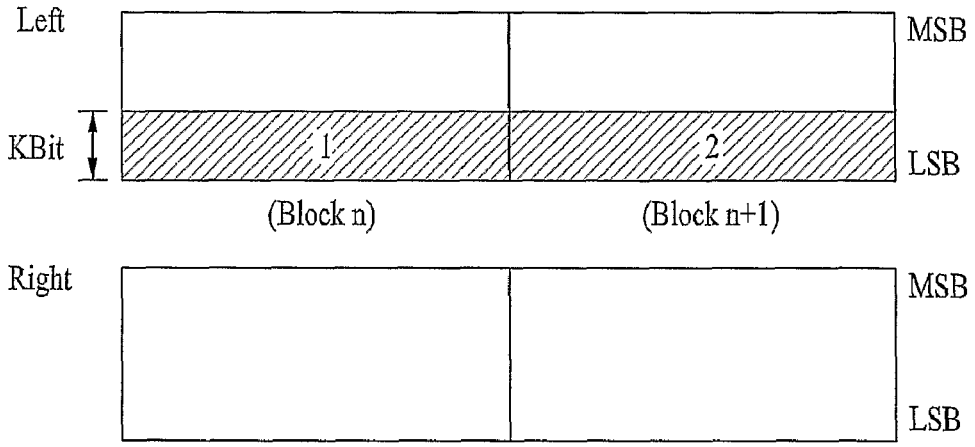
FIG. 18 is a diagram of a first method of embedding a spatial information bitstream in an audio signal downmixed on at least one channel according to the present invention.

FIG. 18 is a diagram of a first method of embedding a spatial information bitstream in an audio signal downmixed on at least one channel according to the present invention.

In case that a downmix signal is configured with at least one channel, spatial information can be regarded as data in common to the at least one channel. So, a method of embedding the spatial information by dispersing the spatial information on the at least one channel is needed.

FIG. 18 shows a method of embedding the spatial information on one channel of the downmix signal having the at least one channel.

Referring to FIG. 18, the spatial information is embedded in K-bits of the downmix signal. In particular, the spatial information is embedded in one channel only but is not embedded in the other channel. And, the K value can differ per block or channel.

As mentioned in the foregoing description, bits corresponding to the K value may correspond to lower bits of the downmix signal, which does not put limitation on the present invention. In this case, the spatial information bitstream can be inserted in one channel in a bit plane order from LSB or in a sample plane order.

Figure 19:
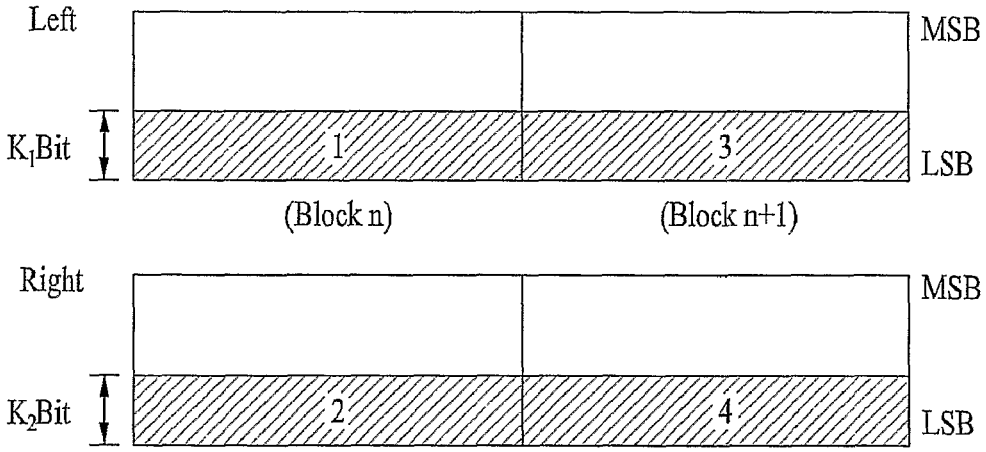
FIG. 19 is a diagram of a second method of embedding a spatial information bitstream in an audio signal downmixed on at least one channels according to the present invention.

FIG. 19 is a diagram of a second method of embedding a spatial information bitstream in an audio signal downmixed on at least one channel according to the present invention. For the convenience of explanation, FIG. 19 shows a downmix signal having two channels, which does not limitation on the present invention.

Referring to FIG. 19, the second method is carried out in a manner of embedding spatial information in a block-n of one channel (e.g., left channel), a block-n of the other channel (e.g., right channel), a block-(n+1) of the former channel (left channel), etc. in turn. In this case, sync information can be embedded in one channel only.

Although a spatial information bitstream can be embedded in a downmix signal per block, it is able to extract the spatial information bitstream per block or frame in a decoding process.

Since signaling characteristics of the two channels of the downmix signal differ from each other, it is able to allocate K values to the two channels differently by finding respective masking thresholds of the two channels separately. In particular, $K_1$ and $K_2$, as shown in the drawing, can be allocated to the two channels, respectively.

In this case, the spatial information can be embedded in each of the channels in a bit plane order from LSB or in a sample plane order.

Figure 20:
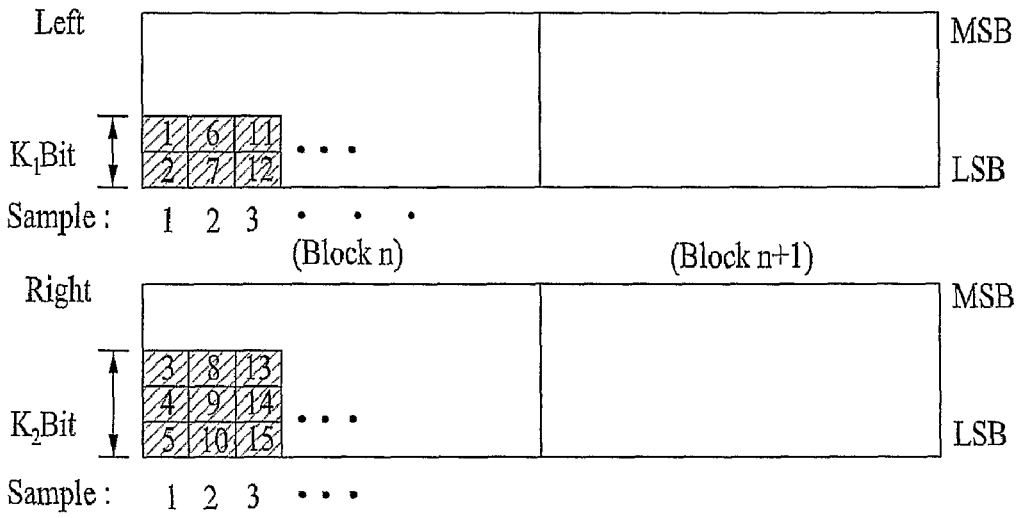
FIG. 20 is a diagram of a third method of embedding a spatial information bitstream in an audio signal downmixed on at least one channel according to the present invention.

FIG. 20 is a diagram of a third method of embedding a spatial information bitstream in an audio signal downmixed on at least one channel according to the present invention. FIG. 20 shows a downmix signal having two channels, which does not put limitation on the present invention.

Referring to FIG. 20, the third method is carried out in a manner of embedding spatial information by dispersing it on two channels. In particular, the spatial information is embedded in a manner of alternating a corresponding embedding order for the two channels by sample unit.

Since signaling characteristics of the two channels of the downmix signal differ from each other, it is able to allocate K values to the two channels differently by finding respective masking thresholds of the two channels separately. In particular, $K_1$ and $K_2$, as shown in the drawing, can be allocated to the two channels, respectively.

The K values may differ from each other per block. For instance, the spatial information is put in lower $K_1$ bits of a sample-1 of one channel (e.g., left channel), lower $K_2$ bits of a sample-1 of the other channel (e.g., right channel), lower $K_1$ bits of a sample-2 of the former channel (e.g., left channel) and lower $K_2$ bits of a sample-2 of the latter channel (e.g., right channel), in turn.

In the drawing, a numeral within parentheses indicates an order of filling the spatial information bitstream. Although FIG. 20 shows that the spatial information bitstream is filled from MSB, the spatial information bitstream can be filled from LSB.

Figure 21:
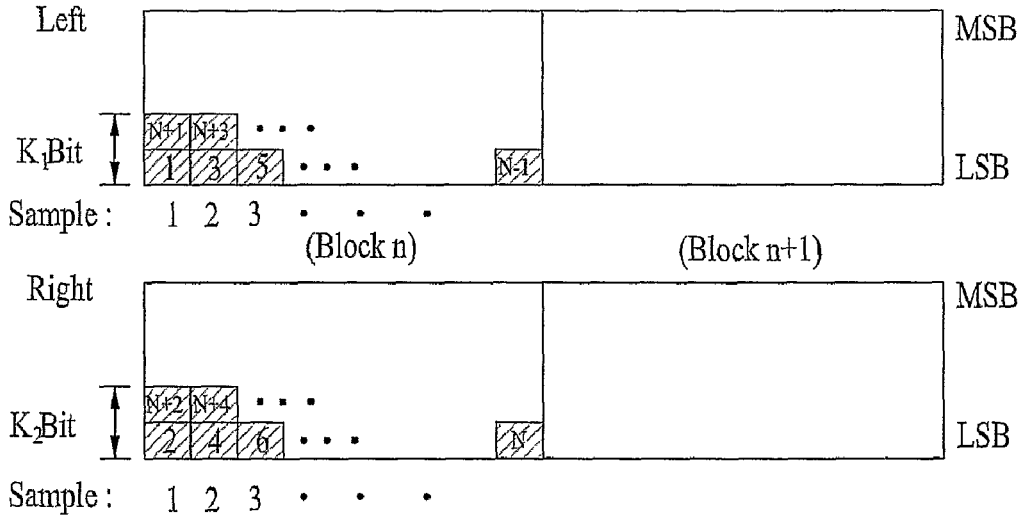
FIG. 21 is a diagram of a fourth method of embedding a spatial information bitstream in an audio signal downmixed on at least one channel according to the present invention.

FIG. 21 is a diagram of a fourth method of embedding a spatial information bitstream in an audio signal downmixed on at least one channel according to the present invention. FIG. 21 shows a downmix signal having two channels, which does not put limitation on the present invention.

Referring to FIG. 21, the fourth method is carried out in a manner of embedding spatial information by dispersing it on at least one channel. In particular, the spatial information is embedded in a manner of alternating a corresponding embedding order for two channels by bit plane unit from LSB.

Since signaling characteristics of the two channels of the downmix signal differ from each other, it is able to allocate K values ($K_1$ and $K_2$) to the two channels differently by finding respective masking thresholds of the two channels separately. In particular, $K_1$ and $K_2$, as shown in the drawing, can be allocated to the two channels, respectively.

The K values may differ from each other per block. For instance, the spatial information is put in a least significant 1 bit of a sample-1 of one channel (e.g., left channel), a least significant 1 bit of a sample-1 of the other channel (e.g., right channel), a least significant 1 bit of a sample-2 of the former channel (e.g., left channel) and a least significant 1 bit of a sample-2 of the latter channel (e.g., right channel), in turn. In the drawing, a numeral within a block indicates an order of filling spatial information.

In case that an audio signal is stored in a storage medium (e.g., stereo CD) having no auxiliary data area or is transferred by SPDIF or the like, L/R channel is interleaved by sample unit. So, it is advantageous for a decoder to process a audio signal according to a received order if the audio signal is stored by the third or fourth method.

And, the fourth method is applicable to a case that a spatial information bitstream is stored by being rearranged by bit plane unit.

As mentioned in the foregoing description, in case that a spatial information bitstream is embedded by being dispersed on two channels, it is able to differently allocate K values to the channels, respectively. In this case, it is possible to separately transfer the K value per each of the channels within the bitstream. In case that a plurality of K values are transferred, differential encoding is applicable to a case of encoding the K values.

Figure 22:
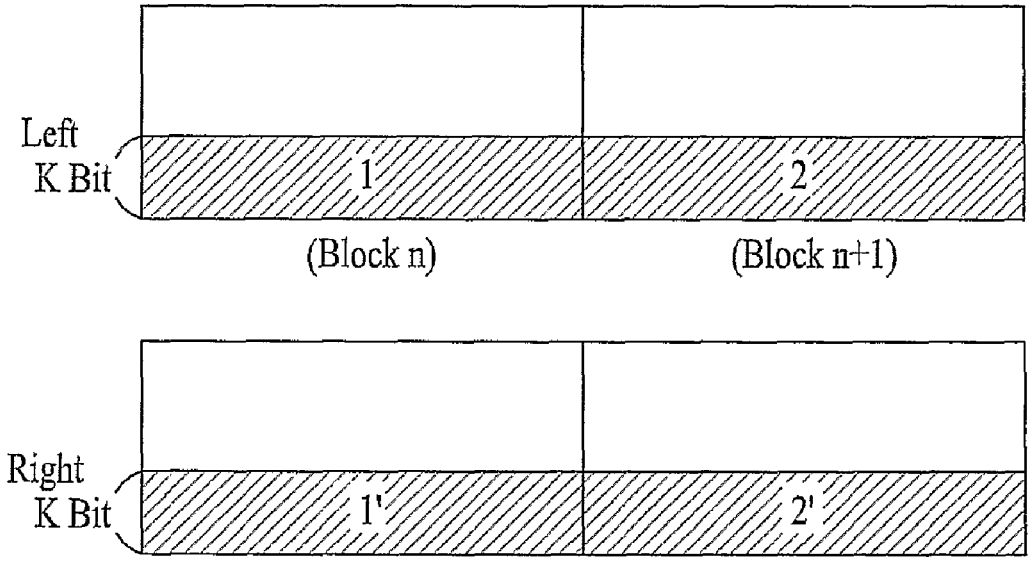
FIG. 22 is a diagram of a fifth method of embedding a spatial information bitstream in an audio signal downmixed on at least one channel according to the present invention.

FIG. 22 is a diagram of a fifth method of embedding a spatial information bitstream in an audio signal downmixed on at least one channel according to the present invention. FIG. 22 shows a downmix signal having two channels, which does not put limitation on the present invention.

Referring to FIG. 22, the fifth method is carried out in a manner of embedding spatial information by dispersing it on two channels. In particular, the fifth method is carried out in a manner of inserting the same value in each of the two channels repeatedly.

In this case, a value of the same sign can be inserted in each of the at least two channels or the values differing in signs can be inserted in the at least two channels, respectively.

For instance, a value of 1 is inserted in each of the two channels or values of 1 and −1 can be alternately inserted in the two channels, respectively.

The fifth method is advantageous in facilitating a transmission error to be checked by comparing a least significant insertion bits (e.g., K bits) of at least one channel.

In particular, in case of transferring a mono audio signal to a stereo medium such as a CD, since channel-L (left channel) and channel-R (right channel) of a downmix signal are identical to each other, robustness and the like can be enhanced by equalizing the inserted spatial information. In this case, the spatial information can be embedded in each of the channels in a bit plane order from LSB or in a sample plane order.

Figure 23:
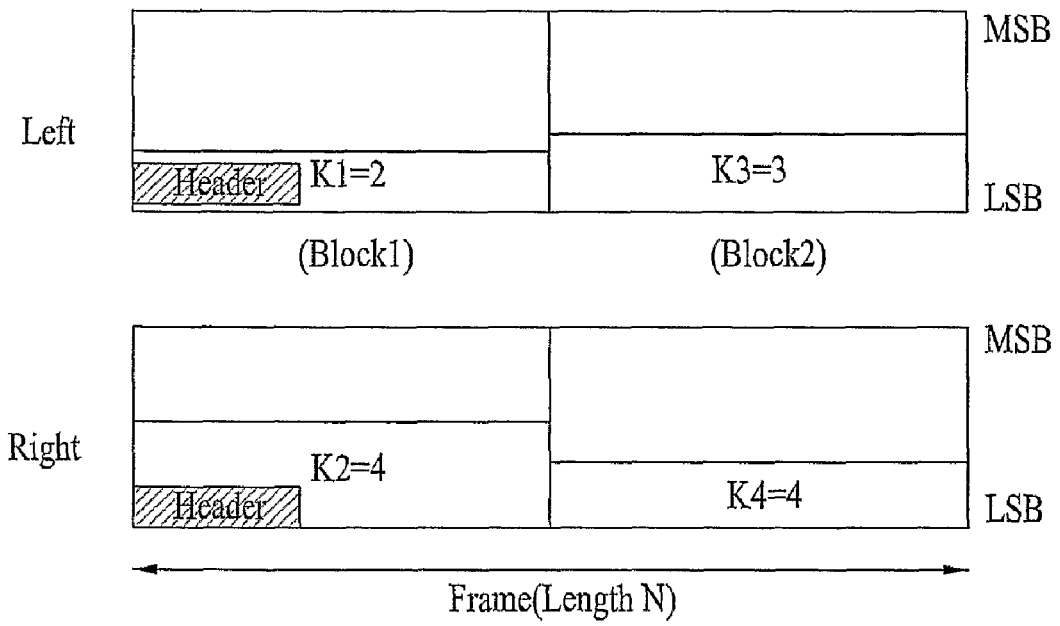
FIG. 23 is a diagram of a sixth method of embedding a spatial information bitstream in an audio signal downmixed on at least one channel according to the present invention.

FIG. 23 is a diagram of a sixth method of embedding a spatial information bitstream in an audio signal downmixed on at least one channel according to the present invention.

The sixth method relates to a method of inserting spatial information in a downmix signal having at least one channel in case that a frame of each channel includes a plurality of blocks (length B).

Referring to FIG. 23, insertion bit lengths (i.e., K values) may have different values per channel and block, respectively or may have the same value per channel and block.

The insertion bit lengths (e.g., $K_1$, $K_2$, $K_3$ and $K_4$) can be stored within a frame header transmitted once for a whole frame. And, the frame header cab be located at LSB. In this case, the header can be inserted by bit plane unit. And, spatial information data can be alternately inserted by sample unit or by block unit. In FIG. 23, a number of blocks within a frame is 2. So, a length (B) of the block is N/2. In this case, a number of bits inserted in the frame is (K1+K2+K3+K4)*B.

Figure 24:
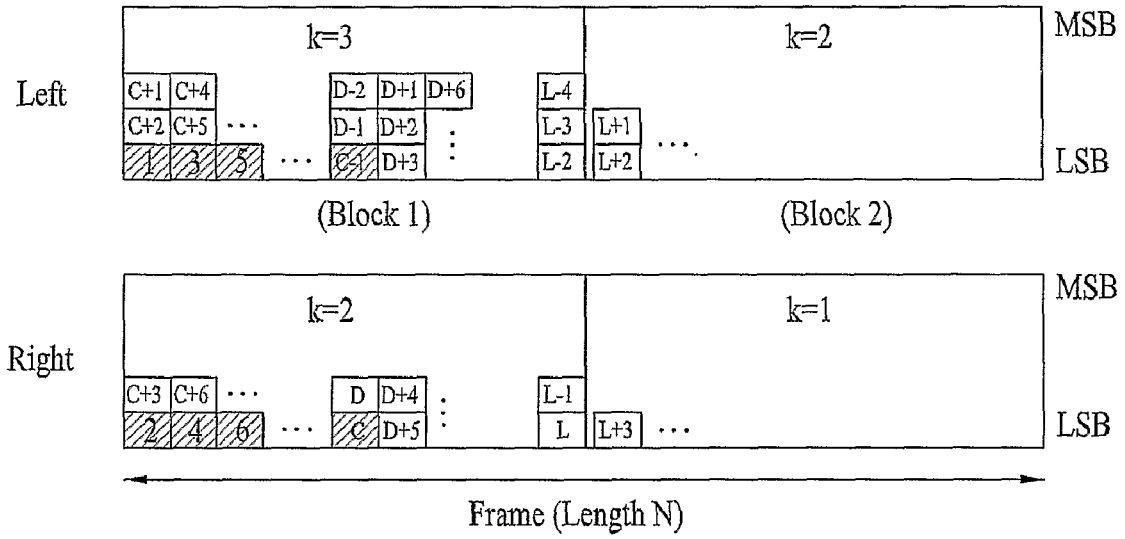
FIG. 24 is a diagram of a seventh method of embedding a spatial information bitstream in an audio signal downmixed on at least one channel according to the present invention.

FIG. 24 is a diagram of a seventh method of embedding a spatial information bitstream in an audio signal downmixed on at least one channel according to the present invention. FIG. 24 shows a downmix signal having two channels, which does not put limitation on the present invention.

Referring to FIG. 22, the seventh method is carried out in a manner of embedding spatial information by dispersing it on two channels. In particular, the seventh method is characterized in mixing a method of inserting the spatial information in the two channels in a bit plane order from LSB or MSB alternately and a method of inserting the spatial information in the two channels alternately by sample plane order.

The method is performed by frame unit or can be performed by block unit.

Hatching portions 1 to C, as shown in FIG. 24, correspond to a header and can be inserted in LSB or MSB in a bit plane order to facilitate a search for an insertion frame sync word.

Other portions (non-hatching portions) C+1 and higher correspond to portions excluding the header and can be inserted in two channels alternately by sample unit to facilitate spatial information data to be extracted out. Insertion bit sizes (e.g., K values) can have different or same values from each other per channel and block. And, the all insertion bit lengths can be included in the header.

Figure 25:
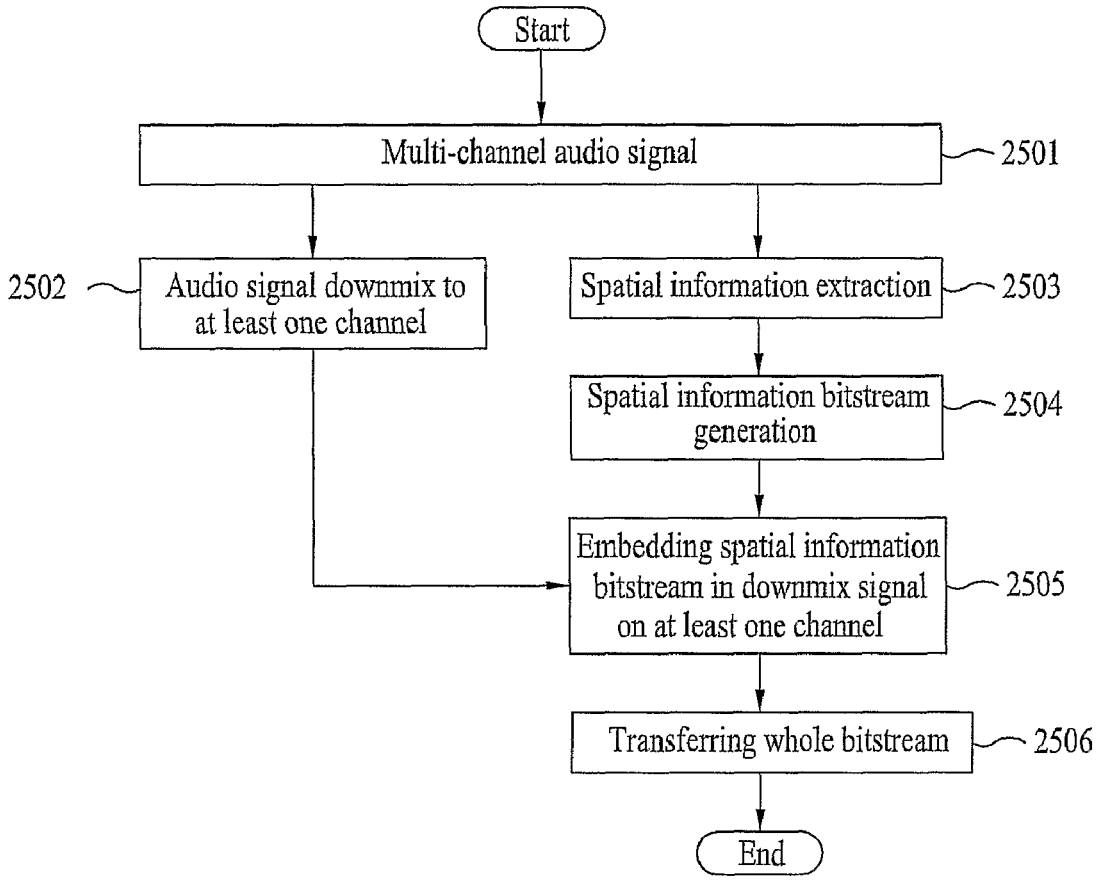
FIG. 25 is a flowchart of a method of encoding a spatial information bitstream to be embedded in an audio signal downmixed on at least one channel according to the present invention.

FIG. 25 is a flowchart of a method of encoding spatial information to be embedded in a downmix signal having at least one channel according to the present invention.

Referring to FIG. 25, an audio signal is downmixed into one channel from a multi-channel audio signal (2501, 2502). And, spatial information is extracted from the multi-channel audio signal (2501, 2503).

A spatial information bitstream is then generated using the extracted spatial information (2504).

The spatial information bitstream is embedded in the downmix signal having the at least one channel (2505). In this case, one of the seven methods for embedding the spatial information bitstream in the at least one channel can be used.

Subsequently, a whole stream including the downmix signal having the spatial information bitstream embedded therein is transferred (2506). In this case, the present invention finds a K value using the down mix signal and can embed the spatial information bitstream in the K bits.

Figure 26:
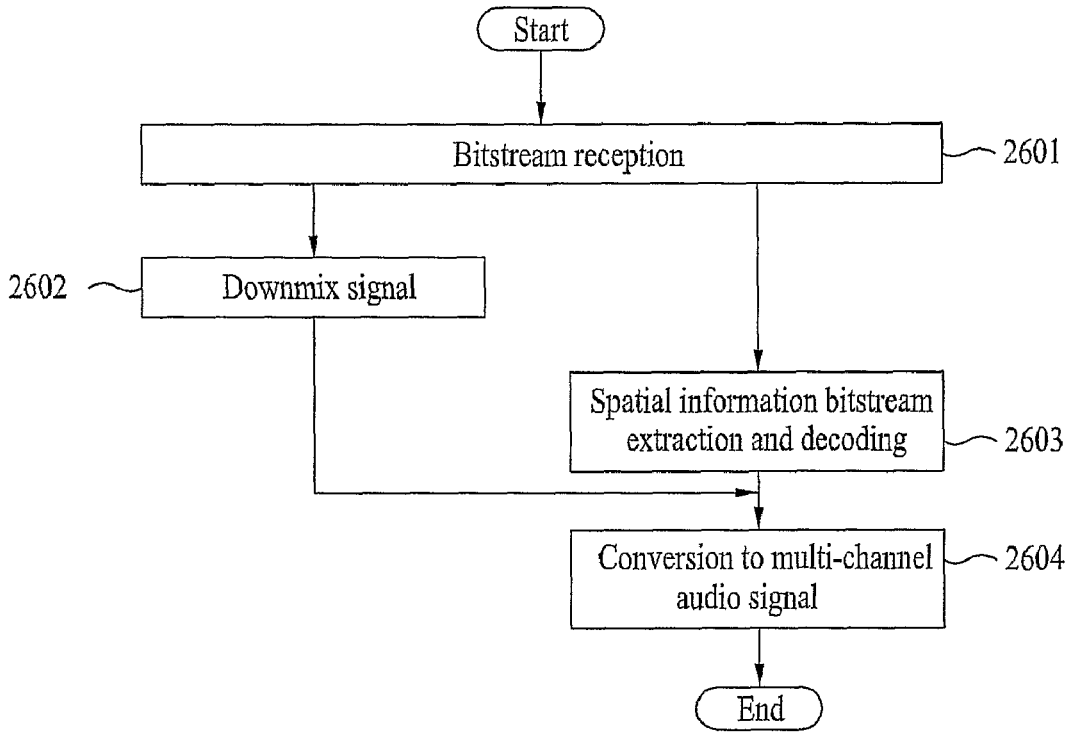
FIG. 26 is a flowchart of a method of decoding a spatial information bitstream embedded in an audio signal downmixed on at least one channel according to the present invention.

FIG. 26 is a flowchart of a method of decoding a spatial information bitstream embedded in a downmix signal having at least one channel according to the present invention.

Referring to FIG. 26, a spatial decoder receives a bitstream including a downmix signal in which a spatial information bitstream is embedded (2601).

The downmix signal is detected from the received bitstream (2602).

The spatial information bitstream embedded in the downmix signal having the at least one channel is extracted and decoded from the received bitstream (2603).

Subsequently, the downmix signal is converted to a multi-channel signal using the spatial information obtained from the decoding (2604).

The present invention extracts discriminating information for an order of embedding the spatial information bitstream and can extract and decode the spatial information bitstream using the discriminating information.

And, the present invention extracts information for a K value from the spatial information bitstream and can decode the spatial information bitstream using the K value.

INDUSTRIAL APPLICABILITY

Accordingly, the present invention provides the following effects or advantages.

First of all, in coding a multi-channel audio signal according to the present invention, spatial information is embedded in a downmix signal. Hence, a multi-channel audio signal can be stored/reproduced in/from a storage medium (e.g., stereo CD) having no auxiliary data area or an audio format having no auxiliary data area.

Secondly, spatial information can be embedded in a downmix signal by various frame lengths or a fixed frame length. And, the spatial information can be embedded in a downmix signal having at least one channel. Hence, the present invention enhances encoding and decoding efficiencies.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A method of decoding an audio signal, comprising:

receiving a downmix signal and spatial information being attached in the downmix signal, the spatial information including frame data;

extracting first discriminating information indicating header data is included in an attaching frame of the spatial information;

extracting second discriminating information based on the first discriminating information, the second discriminating information indicating whether there exists position information indicating position of the downmix signal to which the frame data is applied;

extracting the header data based on the first discriminating information, from the attaching frame of the spatial information;

obtaining the position information based on the second discriminating information; and generating a multi-channel audio signal by applying the header data and the frame data to the downmix signal, according to the position information.

2. An apparatus for decoding an audio signal, comprising:

a receiver receiving a downmix signal and spatial information being attached in the downmix signal, the spatial information including frame data;

an attached signal decoding unit extracting first discriminating information indicating header data is included in an attaching frame of the spatial information, and extracting second discriminating information based on the first discriminating information, the second discriminating information indicating whether there exists position information indicating position of the downmix signal to which the frame data is applied;

a spatial information decoding unit extracting the header data based on the first discriminating information from the attaching frame of the spatial information, and obtaining the position information based on the second discriminating information; and a multi-channel generating unit generating a multi-channel audio signal by applying the header data and the frame data to the downmix signal, according to the position information.

3. A method of encoding an audio signal, comprising:

generating a downmix signal by downmixing a multi-channel audio signal;

generating spatial information indicating an attribute of the multi-channel audio signal;

attaching the spatial information to the downmix signal, an attaching frame of the spatial information including header data and frame data;

generating first discriminating information indicating that the header data is included in the attaching frame of the spatial information;

determining position information indicating position of the downmix signal to which the frame data is applied; and generating second discriminating information indicating whether there exists the position information.

4. An apparatus for encoding an audio signal, comprising:

a downmixing unit generating a downmix signal by downmixing a multi-channel audio signal;

a spatial information decoding unit generating spatial information indicating an attribute of the multi-channel audio signal; and a spatial information attaching unit:

attaching the spatial information to a frame of the downmix signal, an attaching frame of the spatial information including header data and frame data, and generating first discriminating information indicating the header data is included in the attaching frame of the spatial information, determining position information indicating position of the downmix signal to which the frame data is applied, and generating second discriminating information indicating whether there exists the position information.

* * * * *